US008870175B2

(12) United States Patent
Gamo

(10) Patent No.: US 8,870,175 B2
(45) Date of Patent: Oct. 28, 2014

(54) SHEET STACKING APPARATUS AND IMAGE FORMING APPARATUS

(71) Applicant: Canon Kabushiki Kaisha, Tokyo (JP)

(72) Inventor: Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/865,218

(22) Filed: Apr. 18, 2013

(65) Prior Publication Data

US 2013/0285305 A1 Oct. 31, 2013

(30) Foreign Application Priority Data

Apr. 27, 2012 (JP) ..... 2012-103016
Apr. 12, 2013 (JP) ..... 2013-084297

(51) Int. Cl.
*B65H 37/04* (2006.01)
*B65H 39/00* (2006.01)

(52) U.S. Cl.
CPC ..... *B65H 39/00* (2013.01)
USPC ..... 270/58.09; 270/58.11; 270/58.12; 270/58.13

(58) Field of Classification Search
CPC ..... B65H 37/04
USPC ..... 270/58.08, 58.09, 58.11, 58.12, 58.13
See application file for complete search history.

(56) References Cited

U.S. PATENT DOCUMENTS

| | | | | |
|---|---|---|---|---|
| 6,142,469 | A * | 11/2000 | Nanba et al. | 271/288 |
| 6,296,247 | B1 * | 10/2001 | Tamura et al. | 271/214 |
| 6,601,846 | B2 * | 8/2003 | Saito et al. | 271/226 |
| 6,957,810 | B2 * | 10/2005 | Yamada et al. | 270/58.08 |
| 7,014,183 | B2 * | 3/2006 | Tamura et al. | 270/58.09 |
| 7,306,214 | B2 * | 12/2007 | Iida et al. | 270/58.11 |
| 7,331,572 | B2 * | 2/2008 | Yamada et al. | 270/37 |
| 7,661,669 | B2 * | 2/2010 | Ichihashi et al. | 271/207 |
| 7,694,966 | B2 * | 4/2010 | Nagasako et al. | 271/303 |
| 8,678,368 | B2 * | 3/2014 | Yoshida | 270/58.13 |
| 2008/0048380 | A1 * | 2/2008 | Ichihashi et al. | 270/58.09 |
| 2010/0150636 | A1 * | 6/2010 | Kubota et al. | 399/407 |

FOREIGN PATENT DOCUMENTS

JP 2010-195494 A 9/2010

* cited by examiner

*Primary Examiner* — Patrick Mackey
(74) *Attorney, Agent, or Firm* — Fitzpatrick, Cella, Harper & Scinto

(57) ABSTRACT

A pressing portion is lowered to press from above sheets or a sheet bundle discharged onto a discharge tray, and a moving portion configured to lower the pressing portion is controlled so that, in a case where the sheet bundle is discharged onto the discharge tray, the pressing portion exerts a pressing force greater than a pressing force in a case where the sheets are discharged onto the discharge tray.

20 Claims, 19 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus, and more particularly, to a structure for enhancing stacking performance of sheets and sheet bundles to be discharged onto a discharge stacking portion.

2. Description of the Related Art

Conventionally, as an example of image forming apparatus such as a copying machine, a laser beam printer, a facsimile machine, and a multifunction peripheral having functions of those apparatus, there has been used an image forming apparatus including a sheet stacking apparatus configured to stack sheets. Examples of such a sheet stacking apparatus include a sheet processing apparatus configured to perform a binding process and the like on sheets subjected to image formation. The sheet processing apparatus includes an intermediate stacking tray provided therein so that multiple sheets are stacked onto the intermediate stacking tray. In this way, a sheet bundle is formed, and subjected to processes such as the binding process. Then, the sheet bundle is discharged onto a discharge stacking portion.

In the sheet processing apparatus, in a case where sheets or sheet bundles are sequentially discharged onto the discharge stacking portion, sheets or sheet bundles which are precedingly discharged and stacked on the discharge stacking portion may be pushed and moved by sheets or sheet bundles which are subsequently discharged. In this case, stacking performance of the sheets or the sheet bundles to be discharged onto the discharge stacking portion is deteriorated. Conventionally, there has been proposed a sheet processing apparatus including a pressing member configured to press the sheets or the sheet bundles, in which the pressing member is lowered at a time of sheet discharge so that an edge on one side of the sheets or the sheet bundles precedingly stacked on the discharge stacking portion is pressed from the top (refer to Japanese Patent Application Laid-Open No. 2010-195494).

In the conventional sheet stacking apparatus and image forming apparatus including the sheet stacking apparatus, a sensor detects that a stacking height of an upper surface of an uppermost one of the sheets has reached a predetermined height. In response to a detection signal from the sensor, a height position of the discharge stacking portion is controlled and maintained at a predetermined height. In the conventional sheet stacking apparatus, in a case where sheet bundles subjected to the binding process are stacked, when the sheet bundles are stacked under a state in which bound portions thereof are superimposed on each other, as illustrated in FIG. 19A, multiple sheet bundles Sa are stacked under a state in which a bound edge portion St side thereof swells in a thickness direction.

When the sensor detects the swelling part of the sheet bundles Sa, as illustrated in FIG. 19B, a position of a flat edge portion of the sheet bundles Sa subjected to the binding process is on a line P2. However, the detection signal from the sensor indicates that the stacking height of the upper surface of the uppermost one of the sheets corresponds a line P1. Therefore, a discharge stacking portion 9 is lowered by a predetermined amount. In FIG. 19B, a pressing member 8 presses, from the top, an edge on one side of the sheet bundle Sa precedingly stacked on the discharge stacking portion 9. The pressing member 8 is pivotable about a fulcrum 8*a* within a predetermined range in a vertical direction.

When the discharge stacking portion 9 is lowered irrespective of a state in which an actual stacking height of the upper surface of the uppermost one of the sheets corresponds to the line P2, a pressing force of the pressing member 8 when pressing the sheets decreases. For example, when the pressing member 8 is provided with a longer arm and configured to be pivoted by a larger amount, the sheet bundles Sa subjected to the binding process can be firmly pressed by the pressing member 8 even when the discharge stacking portion 9 is lowered.

However, sheets that have not subjected to the binding process may be stacked onto the discharge stacking portion 9, and an actual stacking height of the upper surface of the uppermost one of the sheets in this case corresponds to the line P1. When the pressing member 8, which is provided with the longer arm and configured to be pivoted by the larger amount, presses the sheets having the actual stacking height corresponding to the line P1, the sheets are pressed with an unnecessarily greater pressing force. In this case, a force of moving the sheets by an amount corresponding to an arrow F may be applied along a locus of the pressing member 8, which may disturb the stacked sheets. In this way, when the sheets and the sheet bundles subjected to the binding process are pressed with the pressing member 8, stacking performance deteriorates.

SUMMARY OF THE INVENTION

The present invention has been made in view of the circumstances described above, and provides a sheet stacking apparatus capable of pressing sheets and sheet bundles subjected to a binding process, which are discharged on a discharge stacking portion, without involving deterioration in stacking performance, and further provides an image forming apparatus including the sheet stacking apparatus.

According to an exemplary embodiment of the present invention, there is provided a sheet stacking apparatus, including: a sheet stacking portion on which a plurality of sheets is sequentially stacked; a binding portion configured to perform a binding process on one edge portion in a sheet conveying direction of sheets stacked on the sheet stacking portion; a discharge stacking portion onto which the sheets or a sheet bundle, formed from the plurality of sheets and subjected to the binding process in the binding portion, is discharged, the discharge stacking portion being capable of being raised and lowered; a detecting portion configured to detect, on the one edge portion side, a stacking height of an upper surface of the sheets or the sheet bundle stacked on the discharge stacking portion; a raising/lowering portion configured to raise and lower the discharge stacking portion; a pressing portion which is movable in a vertical direction, the pressing portion configured to press from above the sheets or the sheet bundle stacked on the discharge stacking portion; a moving portion configured to lower the pressing portion so as to press from above the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion configured to control, when the sheet bundle is discharged onto the discharge stacking portion, the moving portion so that the pressing portion presses the sheet bundle with a pressing force greater than a pressing force in a case where the sheets are discharged onto the discharge stacking portion.

According to another exemplary embodiment of the present invention, there is provided an image forming apparatus, including: an image forming portion configured to form an image on a plurality of sheets; a sheet stacking portion on which the plurality of sheets having the image formed by the image forming portion is sequentially stacked; a binding portion configured to perform a binding process on one edge portion in a sheet conveying direction of sheets stacked on the sheet stacking portion; a discharge stacking portion onto which the sheets or the sheet bundle, formed from the plurality of sheets and subjected to the binding process in the binding portion, is discharged; a detecting portion configured to detect, on the one edge portion side, a stacking height of an upper surface of the sheets or the sheet bundle stacked on the discharge stacking portion; a raising/lowering portion configured to raise and lower the discharge stacking portion; a pressing portion which is movable in a vertical direction, the pressing portion configured to press from above the sheets or the sheet bundle stacked on the discharge stacking portion; a moving portion configured to lower the pressing portion so as to press from above the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion configured to control, when the sheet bundle is discharged onto the discharge stacking portion, the moving portion so that the pressing portion presses the sheet bundle with a pressing force greater than a pressing force in a case where the sheets are discharged onto the discharge stacking portion.

According to other exemplary embodiment of the present invention, there is provided a sheet stacking apparatus, including: a sheet stacking portion on which a plurality of sheets is sequentially stacked; a binding portion configured to perform a binding process on one edge portion in a sheet conveying direction of sheets stacked on the sheet stacking portion; a discharge stacking portion onto which the sheets or a sheet bundle, formed from a plurality of sheets and subjected to the binding process in the binding portion, is discharged, the discharge stacking portion being capable of being raised and lowered; a detecting portion configured to detect, on the one edge portion side, a stacking height of an upper surface of the sheets or the sheet bundle stacked on the discharge stacking portion; a raising/lowering portion configured to raise and lower the discharge stacking portion; a pressing portion which is movable in a vertical direction, the pressing portion configured to press from above the sheets or the sheet bundle stacked on the discharge stacking portion; a moving portion configured to lower the pressing portion so as to press from above the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion configured to control, when the sheet bundle is discharged onto the discharge stacking portion, the moving portion so that a lowering amount of the pressing portion to press the sheet bundle is larger than a lowering amount of the pressing portion in a case where the sheets are discharged onto the discharge stacking portion According to other exemplary embodiment of the present invention, there is provided an image forming apparatus, including: an image forming portion configured to form an image on a plurality of sheets; a sheet stacking portion on which the plurality of sheets having the image formed by the image forming portion is sequentially stacked; a binding portion configured to perform a binding process on one edge portion in a sheet conveying direction of a sheet bundle which is formed from the plurality of sheets stacked on the sheet stacking portion; a discharge stacking portion onto which the sheets or the sheet bundle which is subjected to the binding process in the binding portion is discharged; a detecting portion configured to detect, on the one edge portion side, a stacking height of an upper surface of the sheets or the sheet bundle stacked on the discharge stacking portion; a raising/lowering portion configured to raise and lower the discharge stacking portion; a pressing portion which is movable in a vertical direction, the pressing portion configured to press from above the sheets or the sheet bundle stacked on the discharge stacking portion; a moving portion configured to lower the pressing portion so as to press from above the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion configured to control, when the sheet bundle is discharged onto the discharge stacking portion, the moving portion so that a lowering amount of the pressing portion to press the sheets or the sheet bundle is larger than a lowering amount of the pressing portion in a case where the sheets are discharged onto the discharge stacking portion As in the present invention, when the sheet bundle is discharged onto the discharge stacking portion, the pressing portion presses the sheet bundle with the pressing force greater than the pressing force in the case where the sheets are discharged onto the discharge stacking portion. Thus, the sheets and the sheet bundle subjected to the binding process, which are discharged onto the discharge stacking portion, can be pressed without involving deterioration in stacking performance.

Further features of the present invention will become apparent from the following description of exemplary embodiments with reference to the attached drawings.

DESCRIPTION OF THE EMBODIMENTS

Figure 1:
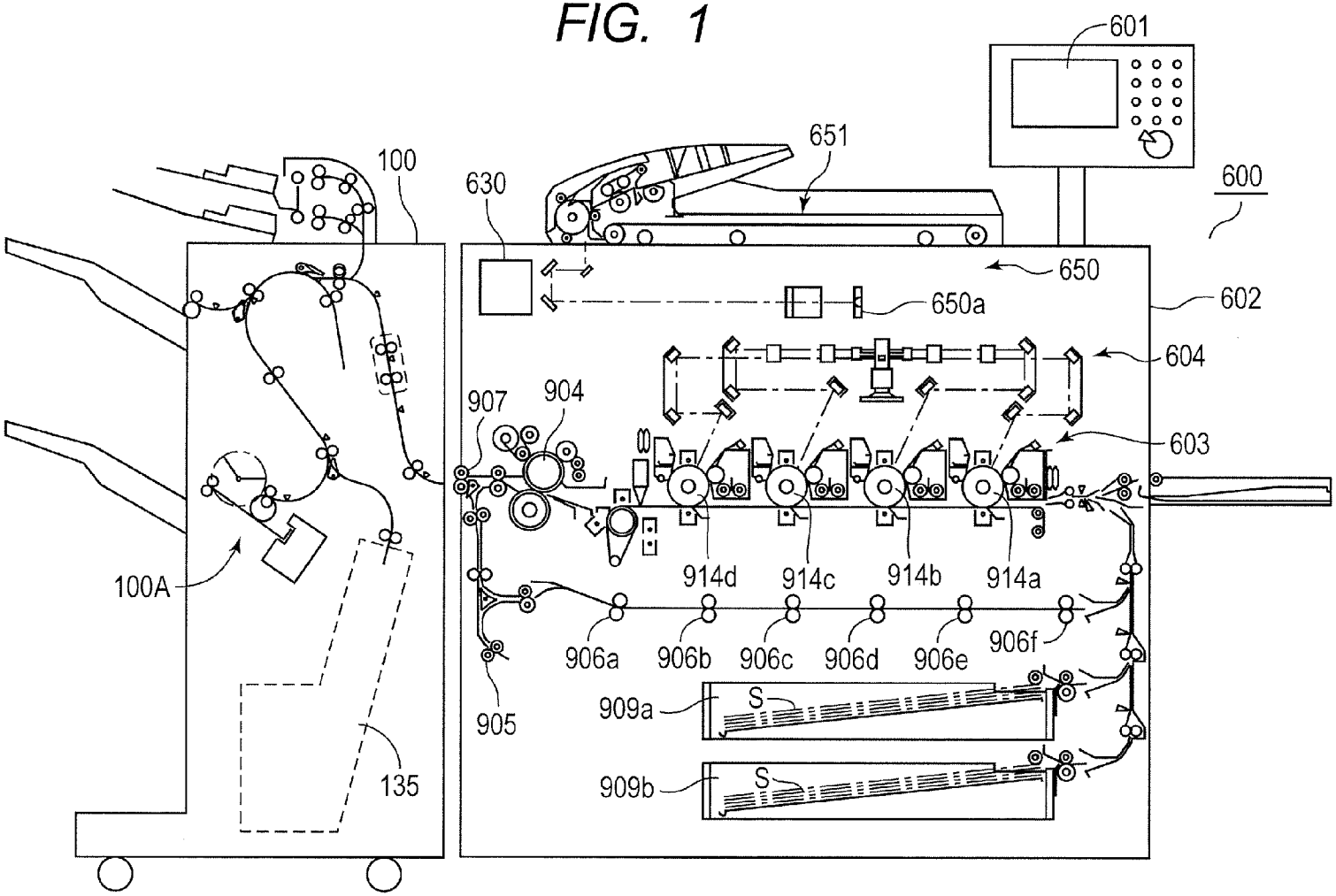
FIG. 1 illustrates a structure of a monochrome/full-color copying machine as an example of an image forming apparatus including a sheet processing apparatus as an example of a sheet stacking apparatus according to a first embodiment of the present invention.

In the following, exemplary embodiments of the present invention are described in detail with reference to the drawings. FIG. 1 illustrates a structure of a monochrome/full-color copying machine as an example of an image forming apparatus including a sheet processing apparatus as an example of a sheet stacking apparatus according to a first embodiment of the present invention. In FIG. 1, an original reading portion (image reader) 650 is provided in an upper portion of a main body (hereinafter referred to as "copying machine main body") 602 of a monochrome/full-color copying machine 600, and an original conveying device 651 automatically reads multiple originals.

The copying machine main body 602 includes sheet feeding cassettes 909*a* and 909*b* configured to stack normal sheets S to be subjected to image formation, an image forming portion 603 configured to form toner images on the sheets S through an electrophotographic printing process, and a fixing portion 904 configured to fix the toner images formed on the sheets S. Further, an operation portion 601 configured to allow a user to perform various inputs/settings with respect to the copying machine main body 602 is connected to an upper surface of the copying machine main body 602. Still further, a finisher 100 as a sheet processing apparatus is connected to a side of the copying machine main body 602. A CPU circuit portion 630 is a control portion configured to control the copying machine main body 602 and the finisher 100.

The monochrome/full-color copying machine 600 forms an image of an original (not shown) on the sheets S as follows. First, the image of the original conveyed by the original conveying device 651 is read with an image sensor 650*a* provided to the original reading portion 650. Then, digital data of the read image is input to an exposure device 604, and the exposure device 604 radiates beams corresponding to the digital data to photosensitive drums 914 (914*a* to 914*d*) provided in the image forming portion 603. When the beams are radiated in this way, electrostatic latent images are formed on surfaces of the photosensitive drums 914. Through development of the electrostatic latent images, yellow, magenta, cyan, and black toner images are formed respectively on the surfaces of the photosensitive drums 914.

Next, the toner images of those four colors are transferred onto the sheet S fed from the sheet feeding cassette 909*a* or 909*b*. Then, the toner images transferred onto the sheet S are permanently fixed with the fixing portion 904. In a mode of forming an image only on one side of the sheet S, after the fixation of the toner images, the sheet S is discharged as it is by a discharge roller pair 907 into the finisher 100 connected to the side portion of the copying machine main body 602.

In a mode of forming images on both sides of the sheet S, the sheet S is delivered from the fixing portion 904 to a reverse roller pair 905. Then, the reverse roller pair 905 is reversed at a predetermined timing so that the sheet S is conveyed toward duplex conveying roller pairs 906*a* to 906*f*. After that, the sheet S is re-conveyed to the image forming portion 603 so that the toner images of the four colors of yellow, magenta, cyan, and black are transferred to a back surface of the sheet S. After the toner images of the four colors are transferred to the back surface of the sheet S, the sheet S is re-conveyed to the fixing portion 904 so that the toner images are fixed. Then, the sheet S is discharged by the discharge roller pair 907, and conveyed into the finisher 100.

The finisher 100 sequentially draws in the sheets S discharged from the copying machine main body 602, and performs processes such as a process of aligning and bundling the multiple sheets S thus drawn in into one bundle, a stapling process (binding process) of stapling a trailing edge side of the sheet bundle, and a bookbinding process. The finisher 100 includes a staple portion 100A as a binding process portion configured to staple the sheets S, and a saddle stitching unit 135 configured to fold the sheet bundle and perform bookbinding.

Figure 2:
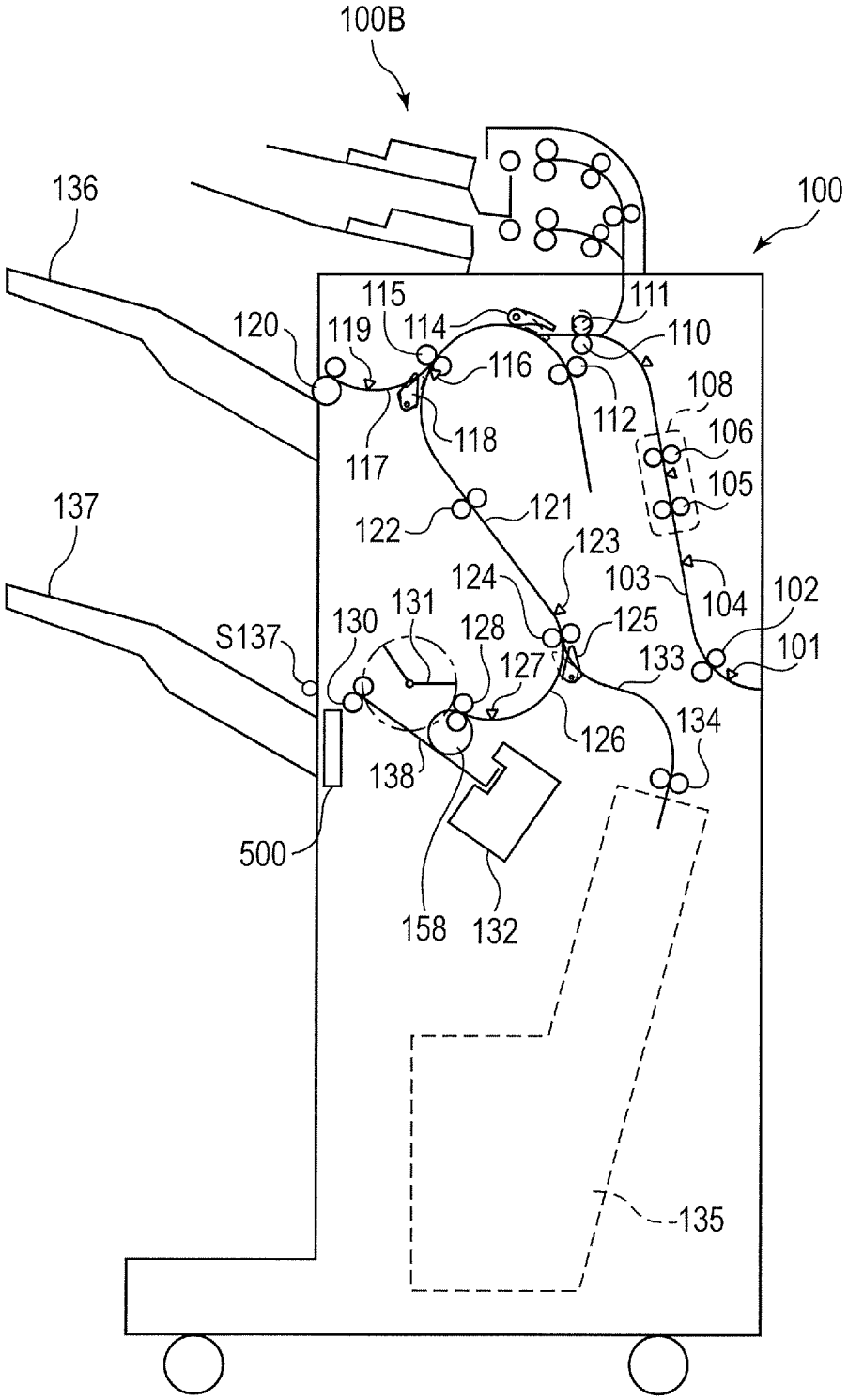
FIG. 2 illustrates a structure of a finisher as the sheet processing apparatus.

As illustrated in FIG. 2, the finisher 100 includes an inlet roller pair 102 configured to draw the sheets S to an inside of the finisher 100. The sheets S discharged from the copying machine main body 602 are delivered to the inlet roller pair 102. Simultaneously, an inlet sensor 101 detects delivery timings of the sheets S.

After that, positions of edge portions of the sheet S conveyed by the inlet roller pair 102 are detected by a lateral registration detecting sensor 104 while the sheet S passes through a conveying path 103. In this way, an amount of widthwise misalignment of the sheet S with respect to a center position of the finisher 100 is detected. After the widthwise misalignment (hereinafter referred to as "lateral registration error") is detected, a shift operation with respect to the sheet S is performed by moving a shift unit 108 in a front direction or a rear direction by a predetermined amount in the middle of conveyance of the sheet S by shift roller pairs 105 and 106. Here, the "front (fore)" refers to a front surface side of the apparatus as viewed from a user standing to face the operation portion 601 illustrated in FIG. 1, and the "rear" refers to a rear surface side of the apparatus.

Then, the sheet S is conveyed by a conveying roller 110 and a separating roller 111, and reaches a buffer roller pair 115. After that, in the case the sheet S is discharged onto an upper tray 136, a drive portion (not shown) such as a solenoid brings an upper path switching member 118 into a state indicated by a broken line of FIG. 2. With this, the sheet S is guided to an upper path conveying path 117, and discharged by an upper discharge roller pair 120 onto the upper tray 136. When the sheet S is not discharged onto the upper tray 136, the sheet S conveyed by the buffer roller pair 115 is guided to a bundle conveyance path 121 by the upper path switching member 118 in a state indicated by a solid line. After that, a conveying roller pair 122 and a bundle conveying roller pair 124 cause the sheet S to sequentially pass through conveying paths.

Next, when the conveyed sheet S is discharged onto a lower stacking tray 137, a saddle stitching path switching member 125 in a state indicated by a solid line causes the sheet S to be conveyed to a lower path 126. After that, a lower discharge roller pair 128 as a sheet conveying portion discharges the sheets S sequentially onto an intermediate stacking tray 138. While being sequentially stacked, the sheets S thus conveyed are aligned by returning portions including paddles 131 and belt rollers 158. In this manner, a predetermined number of the sheets S are subjected to an alignment process on the intermediate stacking tray 138 which is a sheet stacking portion for processing a stacked and aligned sheet bundle.

Next, the sheet bundle subjected to the alignment process on the intermediate stacking tray 138 is subjected as appropriate to the binding process performed by a stapler 132 as a binding process portion, and then discharged by a bundle discharge roller pair 130 onto the stacking tray 137 as a lower discharge stacking portion. The stapler 132 as a binding process portion (processing portion) is movable in a width direction (hereinafter referred to as "front-rear direction") orthogonal to a sheet conveying direction, and is capable of performing the binding process on multiple points of the trailing edge portion which is an upstream edge portion in the sheet conveying direction of the sheet bundle (edge portion on one side in the sheet conveying direction). The stapler 132 is fixed on a slide support base 303 illustrated in FIG. 3, and performs the binding process on the one edge portion of the sheet bundle by a clinch motor M132 illustrated in FIG. 11.

When the sheets S are subjected to a saddle stitching process, a drive portion (not shown) such as a solenoid causes the saddle stitching path switching member 125 to move to a position indicated by a broken line. With this, the sheets S are conveyed to a saddle stitching path 133, and then guided to the saddle stitching unit 135 by a saddle stitching inlet roller pair 134 so as to be subjected to the saddle stitching process. In FIG. 2, an inserter 100B is provided on the finisher 100. The inserter 100B inserts a sheet (insertion sheet) other than normal sheets as a first page or a last page of the sheet bundle, or between the sheets S on each of which an image is formed in the copying machine main body 602.

Figure 3:
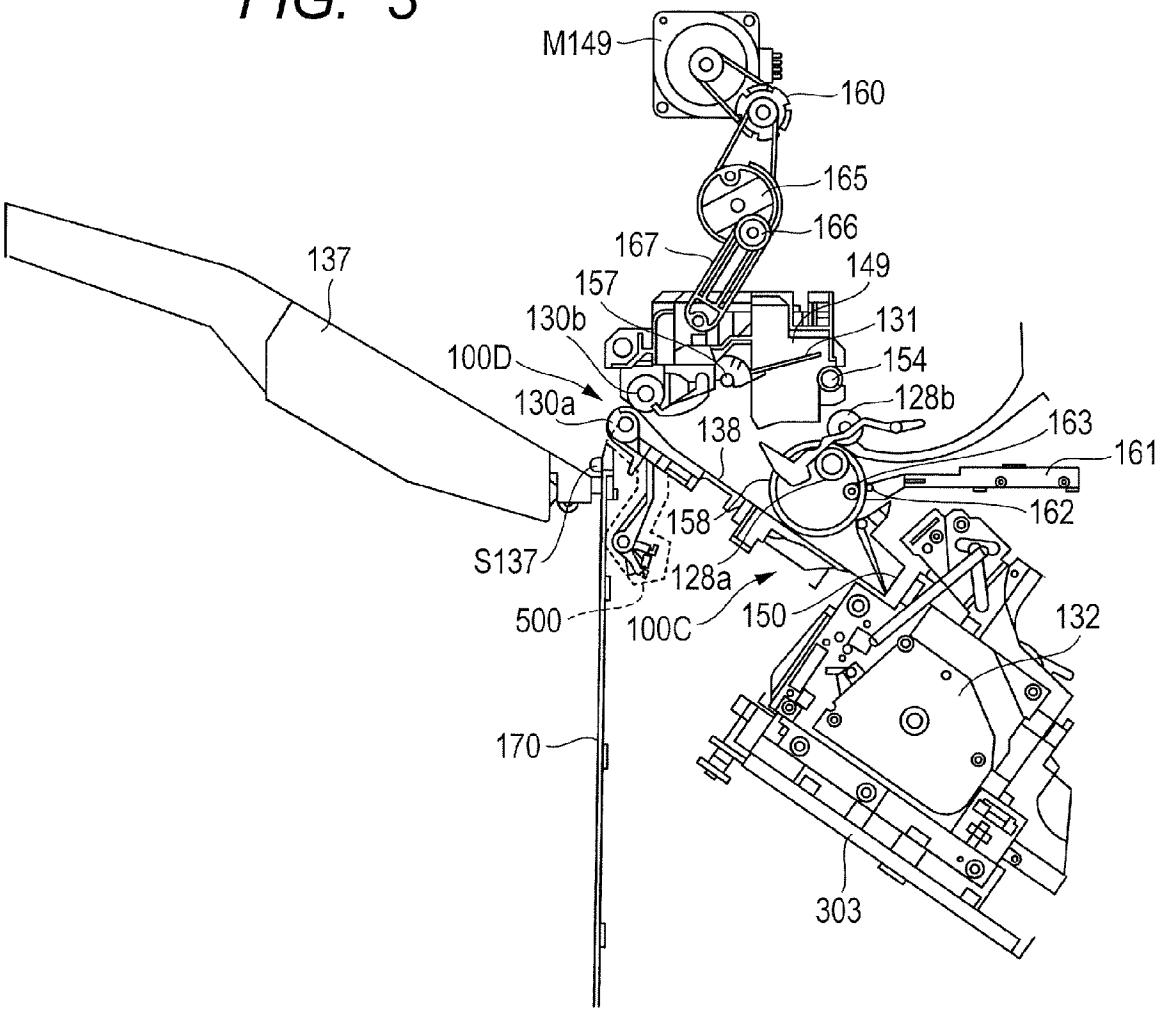
FIG. 3 illustrates a structure of a staple portion provided to the finisher.

Next, a structure of the staple portion 100A including the intermediate stacking tray 138 is described. As illustrated in FIG. 3, the intermediate stacking tray 138 is arranged with respect to a discharge direction of the sheet bundle so that its downstream side (left side of FIG. 3) is upwardly inclined and its upstream side (right side of FIG. 3) is downwardly inclined. Trailing edge stoppers 150 are arranged at a lower edge portion on the upstream side of the intermediate stacking tray 138. The intermediate stacking tray 138 may be horizontally arranged.

Figure 4:
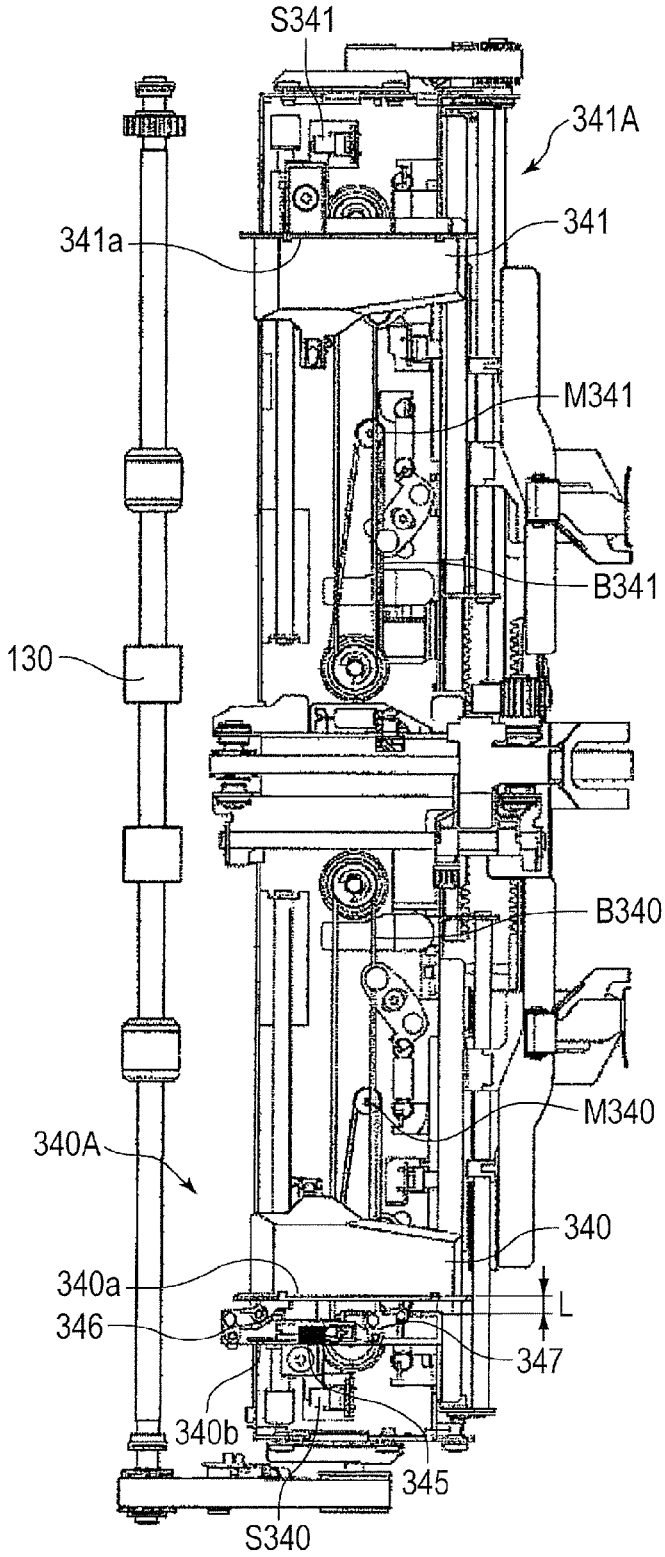
FIG. 4 illustrates a structure of an intermediate stacking tray provided to the staple portion.

The intermediate stacking tray 138 includes an intermediate portion including a front alignment portion 340A and a rear alignment portion 341A as illustrated in FIG. 4, and side edge regulating portions as widthwise alignment portions configured to regulate (align) both side edge positions in the width direction of the sheets S conveyed to the intermediate stacking tray 138. The front alignment portion 340A and the rear alignment portion 341A respectively include a front alignment plate 340 and a rear alignment plate 341 which are alignment members respectively including alignment portions 340*a* and 341*a* as alignment surfaces, and a front alignment plate motor M340 and a rear alignment plate motor M341 configured to respectively and independently drive the front alignment plate 340 and the rear alignment plate 341.

When both the side edge positions of the sheets S are regulated, drives of the front alignment plate motor M340 and the rear alignment plate motor M341 are transmitted to the front alignment plate 340 and the rear alignment plate 341 respectively through intermediation of a timing belt B340 and a timing belt B341 serving as moving portions cooperatively with the front alignment plate motor M340 and the rear alignment plate motor M341. With this, the front alignment plate 340 and the rear alignment plate 341, which can be brought into abutment against and spaced away from the sheets S, independently move along the width direction with respect to the intermediate stacking tray 138 so as to abut against both the side edges of the sheets S stacked on the intermediate stacking tray 138. In this way, the sheets S are aligned.

The front alignment plate 340 and the rear alignment plate 341 are arranged on the intermediate stacking tray 138 in a manner that the respective alignment portions (alignment surfaces) 340*a* and 341*a* face each other, and assembled to be movable forward and reversely in an alignment direction. Thus, even when sheet (or sheet bundle) is conveyed with a shift in the width direction, the position of the sheet on the intermediate stacking tray 138 can be aligned by the front alignment plate 340 and the rear alignment plate 341.

An alignment portion of one of the alignment plates, for example, the alignment portion 340*a* as the alignment surface of the front alignment plate 340 is provided to be movable in the width direction. A tension coil spring 345 is interposed between the alignment portion 340*a* and a main body 340*b* of the front alignment plate 340, and the tension coil spring 345 and moving links 346 and 347 cooperatively cause the alignment portion 340*a* to be projected toward the sheets S by a predetermined amount L. As described below, when the alignment portion 340*a* is brought into press contact with the sheets S when both the side edge positions of each of the sheets S are regulated, the alignment portion 340*a* as a press contact portion is moved to the main body side against the tension coil spring 345.

Figure 5:
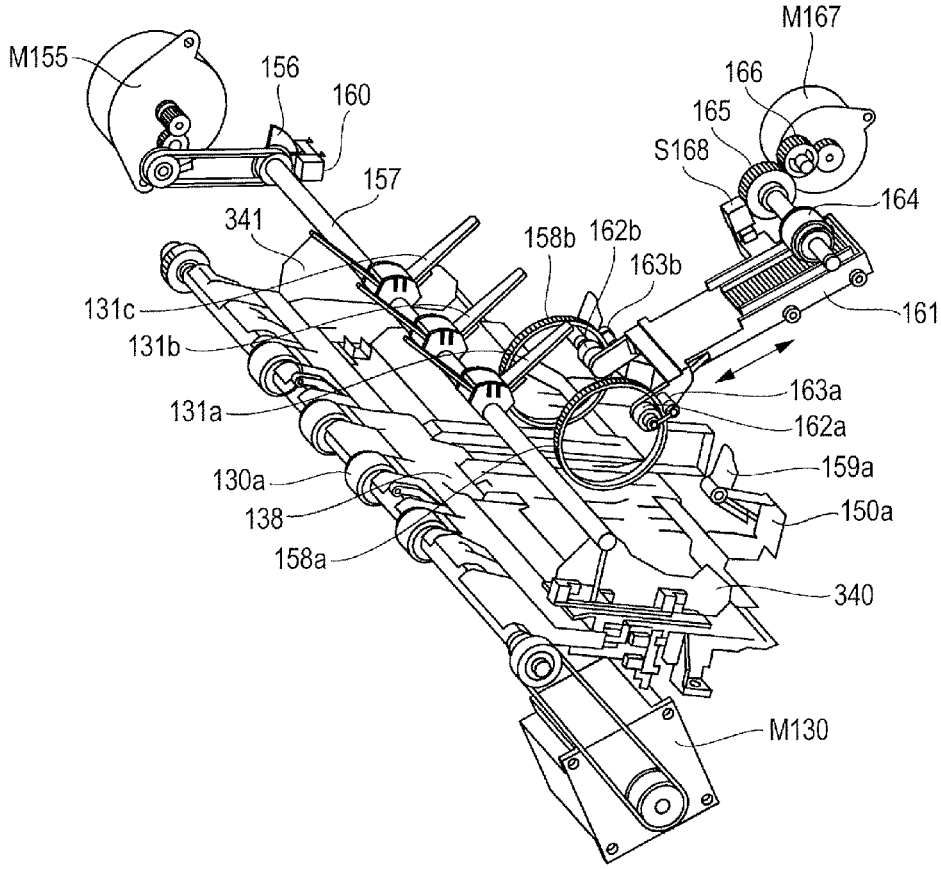
FIG. 5 illustrates a structure of a sheet trailing edge alignment portion provided to the staple portion.

As illustrated in FIG. 3, an upper edge portion of the intermediate stacking tray 138 on a downstream side in a draw-in direction includes the draw-in paddles 131 and an opening/closing guide 149. As illustrated in FIG. 5, multiple draw-in paddles 131 are arranged above the intermediate stacking tray 138, and fixed along and on a drive shaft 157 rotated by a paddle drive motor M155. The paddle drive motor M155 rotates at an appropriate timing in a counterclockwise direction in FIG. 3.

FIG. 3 illustrates a sheet trailing edge alignment portion 100C as a conveying direction alignment portion configured to align positions in the conveying direction of the sheets S, and a discharge port 100D. As illustrated in FIG. 5, the sheet trailing edge alignment portion 100C includes the belt rollers 158 (158*a* and 158*b*) which are rotary members, trailing edge lever 159 (159*a* and 159*b*), and trailing edge stoppers 150 (150*a* and 150*b*) as regulating members which abut against upstream edges in the conveying direction. The sheets S conveyed onto the intermediate stacking tray 138 are guided by the trailing edge lever 159 by counterclockwise rotation of the draw-in paddles 131 (131*a*, 131*b*, and 131*c*) and the belt rollers 158, and upstream edges in the conveying direction are brought into abutment against the trailing edge stoppers 150. In this way, the positions in the conveying direction of the sheets S are aligned.

The belt rollers 158, each of which is an endless belt, are provided to be capable of being raised and lowered (movable) above the intermediate stacking tray 138, and are each looped around an outer periphery of a first discharge roller 128*a* (refer to FIG. 3) of the lower discharge roller pair 128. The belt rollers 158 are respectively nipped by nip rollers A162 (162*a* and 162*b*) and nip rollers B163 (163*a* and 163*b*) provided at a leading end of a belt moving member 161.

The belt rollers 158 are rotated counterclockwise by being driven along with rotation of the first discharge roller 128*a* while being nipped by the nip rollers A162 and the nip rollers B163 and maintaining a positional relationship in which a lower portion of each of the belt rollers 158 comes into contact with an uppermost one of the sheets S stacked on the intermediate stacking tray 138. With this, the sheets S conveyed onto the intermediate stacking tray 138 are conveyed in a direction reverse to the conveying direction, and the upstream edges in the sheet conveying direction, each of which is an edge on one side in the sheet conveying direction of each of the sheets S, abut against the trailing edge stoppers 150.

A shape of the belt rollers 158 can be elastically deformed by moving the belt moving member 161 in arrow directions with a belt moving motor M167 through intermediation of a rack gear 164. With this, the belt rollers 158 are movable upward and downward with respect to the position at which the belt rollers 158 come into contact with the uppermost one of the sheets S. The belt moving member 161 is controlled in position while an edge of the belt moving member 161 is detected by a belt movement home sensor S168.

As illustrated in FIG. 3, the opening/closing guide 149 is supported to be pivotable about a support shaft 154, and is arranged as an upper conveying guide facing the intermediate stacking tray 138. The opening/closing guide 149 rotatably holds upper bundle discharge rollers 130*b* which serve as the bundle discharge roller pair 130 cooperatively with lower bundle discharge rollers 130*a* provided at a downstream edge portion of the intermediate stacking tray 138.

The opening/closing guide 149 holds the upper bundle discharge rollers 130*b* so that the upper bundle discharge rollers 130*b* can be brought into abutment against and spaced away from the lower bundle discharge rollers 130*a*. Along with rocking of the opening/closing guide 149, the upper bundle discharge rollers 130*b* are bring into abutment against and spaced away from the lower bundle discharge rollers 130*a*. Normally, when the sheets S are conveyed onto the intermediate stacking tray 138, the opening/closing guide 149 rocks upward. In accordance therewith, the upper bundle discharge rollers 130*b* are spaced away from the lower bundle discharge rollers 130*a* as counterpart rollers in the bundle discharge roller pair 130. In this way, an opened state is reached.

When processes on the sheets S on the intermediate stacking tray 138 are completed, the opening/closing guide 149 is rocked downward by rotation of an opening/closing motor M149. In this way, the sheet bundle is nipped between the upper bundle discharge rollers 130*b* and the lower bundle discharge rollers 130*a*. The bundle discharge roller pair 130 (for example, lower bundle discharge rollers 130*a*) is rotated forward and reversely by a bundle discharge drive motor M130 (refer to FIG. 11).

After that, the bundle discharge roller pair 130 is rotated under the state in which the sheet bundle is nipped between the upper bundle discharge rollers 130*b* and the lower bundle discharge rollers 130*a*. With this, the sheet bundle is discharged onto the lower stacking tray 137 through the discharge port 100D. The stacking tray 137 is inclined to be higher on a downstream side in the discharge direction. Thus, when the sheet bundle is discharged onto the stacking tray 137, the inclination of the stacking tray 137 causes an upstream edge in the discharge direction of the sheet bundle to abut against a stacking wall 170 as a regulating member provided below the discharge port 100D. In this way, a position of the upstream edge of the sheet bundle in the discharge direction is regulated.

The opening/closing guide 149 rocks upward during conveyance of the sheets S to be processed onto the intermediate stacking tray 138. Thus, the inclination of the intermediate stacking tray 138 and action of the draw-in paddles 131 cause the sheets S conveyed from the lower discharge roller pair 128 to slide down on a stacking surface of the intermediate stacking tray 138 or on sheets S stacked on the intermediate stacking tray 138. After thus sliding down, the sheets S are conveyed (transported) while being guided by the trailing edge levers 159 by counterclockwise rotation of the belt rollers 158 as sheet conveying portions, and stopped when the trailing edges (upstream edges in the conveying direction) are brought into abutment against the trailing edge stoppers 150.

Figure 6:
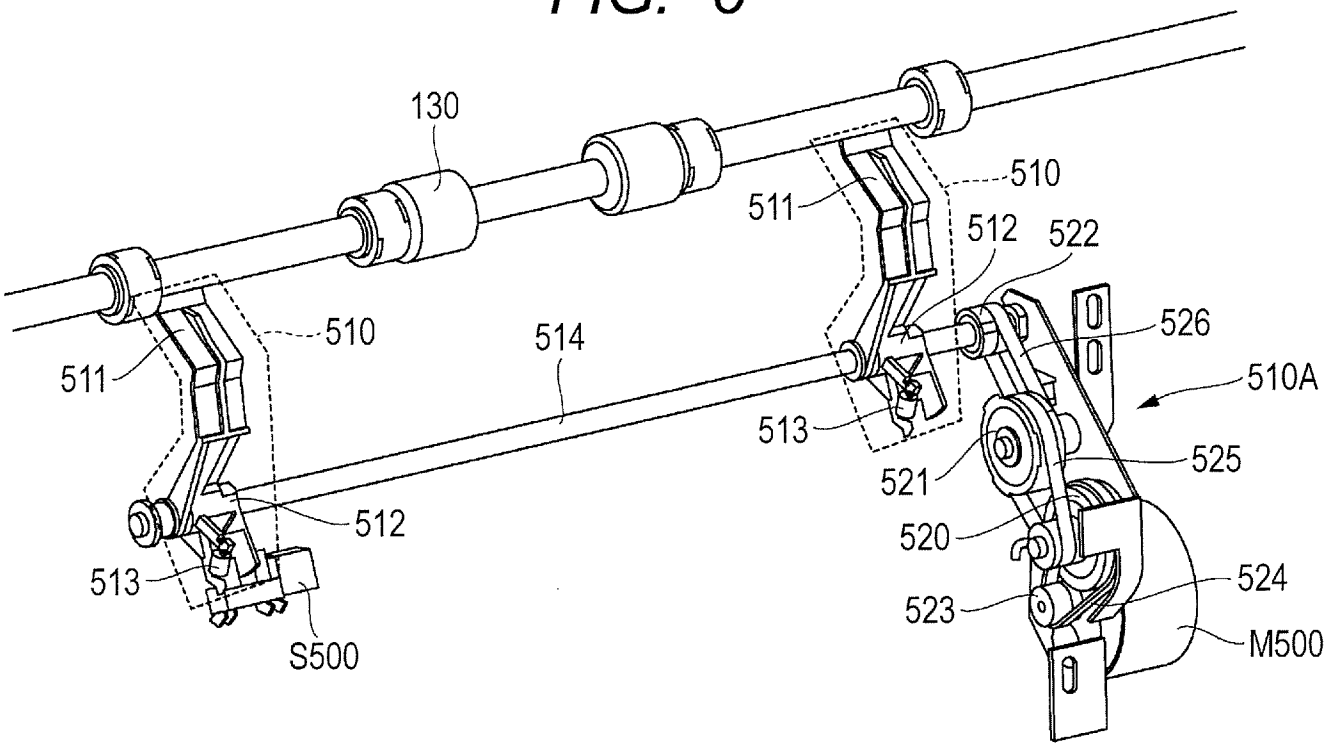
FIG. 6 is a first view illustrating a structure of a stacked sheet pressing unit provided to the staple portion.
Figure 7A:
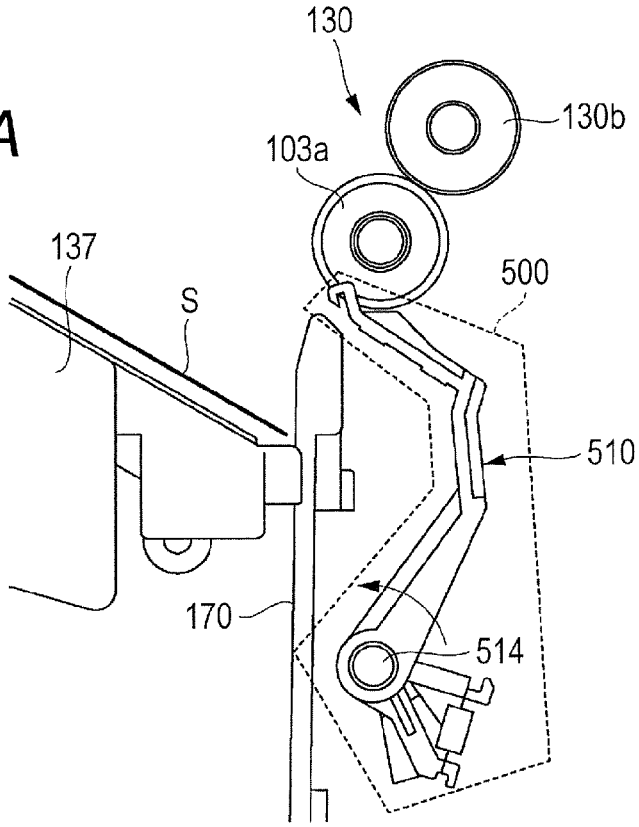
FIGS. 7A and 7B are second views illustrating the structure of the stacked sheet pressing unit provided to the staple portion.

In this embodiment, as illustrated in FIGS. 2 and 3, there is provided a stacked sheet pressing unit 500 configured to press sheets S on the stacking tray 137 or sheet bundles each formed of multiple sheets S conveyed onto the intermediate stacking tray 138. As illustrated in FIGS. 6 and 7A, the stacked sheet pressing unit 500 is arranged below the bundle discharge roller pair 130. As illustrated in FIG. 6, the stacked sheet pressing unit 500 includes, along the width direction, multiple pressing portions 510 as pressing portions configured to press the sheets S on the stacking tray 137 which is a discharge stacking portion capable of being raised and lowered. In this embodiment, there are two stacked sheet pressing units 500 along the width direction.

The pressing portions 510 respectively include pressing members 511 configured to press the sheets S or the sheet bundle on the stacking tray 137 by pivoting in a vertical direction about a pivot shaft 514 through the drive of a sheet pressing portion drive motor M500. The drive of the sheet pressing portion drive motor M500 is transmitted to a pulley 522 through intermediation of a leading end pulley 523 provided to a shaft of the sheet pressing portion drive motor M500, timing belts 524 to 526, and pulleys 520 and 521. The drive is transmitted from the pulley 522 to the pivot shaft 514 through intermediation of a parallel pin. Thus, the pivot shaft 514 is rotated by the drive of the sheet pressing portion drive motor M500, and along therewith, the pressing portions 510 are also pivoted (moved) in the vertical direction. In other words, in this embodiment, the sheet pressing portion drive motor M500, the timing belts 524 to 526 and the pulleys 520 to 522 constitute a moving portion 510A configured to pivot (move) the pressing portions 510 in the vertical direction.

Figure 7B:
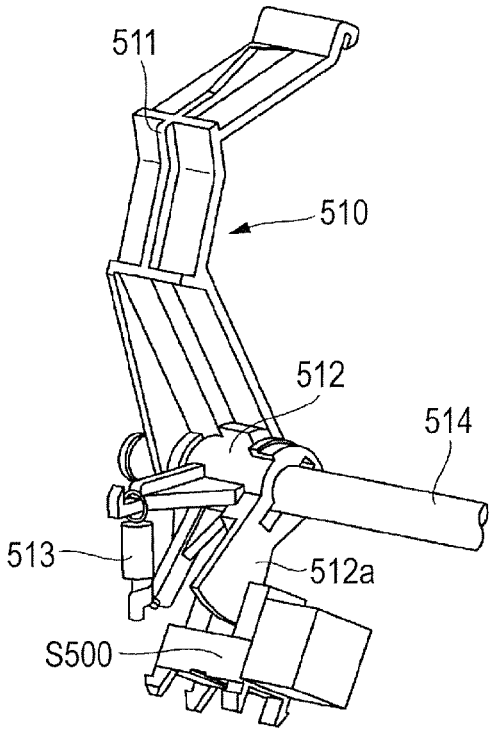

As illustrated in FIG. 7B, the pressing portion 510 includes the pressing member 511 configured to press the sheet S, a drive transmission member 512 as a support member configured to support the pressing member 511 so as to be pivotable, and a pressing spring 513. The drive transmission member 512 is fixed to the pivot shaft 514 through intermediation of the parallel pin, and the pressing member 511 is supported to be pivotable within a predetermined angular range by the drive transmission member 512. In other words, the pressing member 511 is supported to be pivotable about the pivot shaft 514 through intermediation of the drive transmission member 512. With this, the pressing member 511 is pivotable with respect to the pivot shaft 514 independently of the drive transmission member 512.

The drive transmission member 512 includes a sensor flag 512*a*, and counterpart pressing portion 510 is provided with a sheet pressing portion HP sensor S500 corresponding to the sensor flag 512*a* of the drive transmission member 512. A finisher control portion 636 illustrated in FIG. 11 controls pivoting positions (pivot amounts) of the pressing portions 510 by controlling the drive of the sheet pressing portion drive motor M500 in response to a signal from the sheet pressing portion HP sensor S500.

The pressing spring 513 is a tension coil spring bridged between the pressing member 511 and the drive transmission member 512. When torque is applied to the drive transmission member 512 along with rotation of the pivot shaft 514, the torque is transmitted to the pressing member 511 through intermediation of the pressing spring 513, and the pressing member 511 is pivoted. In other words, when the drive transmission member 512 is pivoted along with the rotation of the pivot shaft 514, rotational torque is transmitted to the pressing member 511 through intermediation of the pressing spring 513, and hence the pressing member 511 is simultaneously pivoted.

Figure 8A:
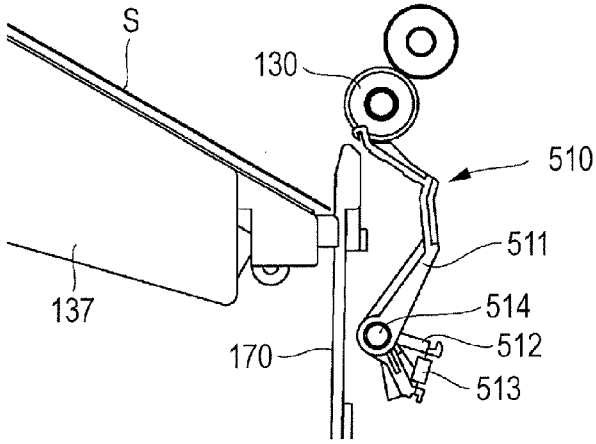
FIGS. 8A, 8B and 8C illustrate a series of sheet pressing operations performed by the stacked sheet pressing unit.
Figure 8B:
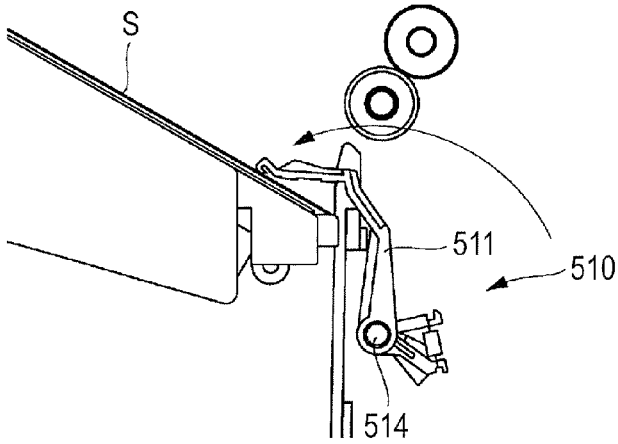

Next, a series of sheet pressing operations by the stacked sheet pressing unit 500 structured as described above is described with reference to FIGS. 8A to 8C. First, as illustrated in FIG. 8A, in response to the discharge of the sheet S onto the stacking tray 137, the sheet pressing portion drive motor M500 is driven to pivot the drive transmission member 512 about the pivot shaft 514. When the drive transmission member 512 is pivoted in this way, the pressing member 511 is pivoted downward about the pivot shaft 514 through intermediation of the pressing spring 513. Subsequently, as illustrated in FIG. 8B, the pressing member 511 abuts against the sheet S on the stacking tray 137.

Figure 8C:
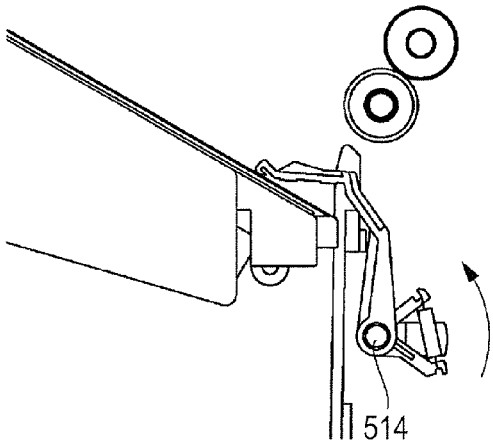

When the pressing member 511 abuts against the sheet S on the stacking tray 137, the pivoting of the pressing member 511 is stopped. However, the pivot shaft 514 continues to be rotated after that, and hence, as illustrated in FIG. 8C, the drive transmission member 512 continues to be pivoted while pulling the pressing spring 513. With this, the pressing member 511 and the drive transmission member 512 are pivoted relative to each other. Thus, tension of the pressing spring 513, which is generated by such pulling, is converted to torque and transmitted to the pressing member 511, and acts as a pressing force for pressing the sheet S. As a result, as the pressing spring 513 is pulled more forcefully, in other words, as the pressing member 511 is pivoted further downward, the pressing member 511 presses an upper surface of an uppermost one sheet or the sheet bundle with a greater pressing force.

In this embodiment, the pivot amount (lowering amount) of the pressing portion 510 at this time varies in accordance with whether the discharged sheets S have been bound or unbound. For example, the pivot amount of the pressing portion 510 in a case of discharging the unbound sheets S is set to be equal to an amount of pivoting to a line P1 in FIG. 19B, which indicates an upper surface position in a case of stacking the unbound sheets S. Meanwhile, the pivot amount of the pressing portion 510 in a case of discharging the bound sheets S is set to be equal to an amount of pivoting to a line P2 in FIG. 19B, which indicates an upper surface position in a case of stacking the bound sheets S.

Thus, the pressing force of the pressing portion 510 is greater in the case of discharging the bound sheets S than in the case of discharging the unbound sheets S. The pressing force of the pressing portion 510 is controlled in accordance with whether or not the binding process is performed. Thereby, it adapts to variation in height of the sheet surface in the case of stacking the sheet bundles subjected to the binding process, and the sheets S that have not been subjected to the binding process can also be pressed without involving deterioration in stacking performance.

When a sheet S or a sheet bundle is discharged, the edge portion (leading edge) of the discharged sheet S or the discharged sheet bundle may collide against and push out stacked sheets S or stacked sheet bundles in the sheet discharge direction. In this embodiment, in order to prevent the stacked sheets S or the stacked sheet bundles from being pushed out by the discharged sheet S or the discharged sheet bundle, the sheet pressing unit 500 presses the sheets S or the sheet bundles stacked on the stacking tray 137 prior to the subsequent discharge of the sheet S or the sheet bundle.

Figure 9A:
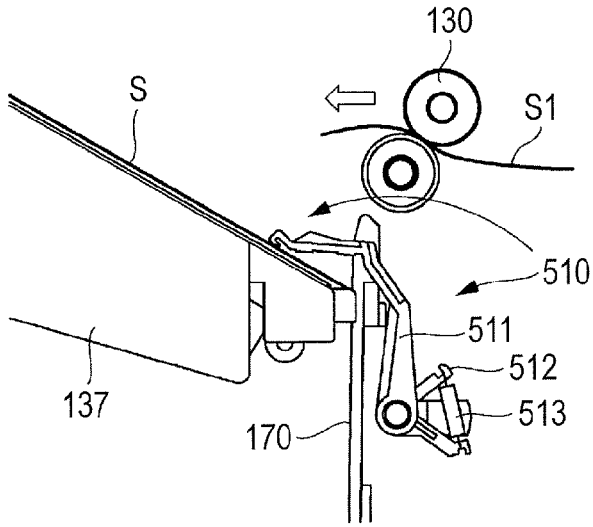
FIGS. 9A, 9B and 9C illustrate series of sheet pressing operations in which sheets on a stacking tray are pressed by the stacked sheet pressing unit before a subsequent sheet is discharged.
Figure 9B:
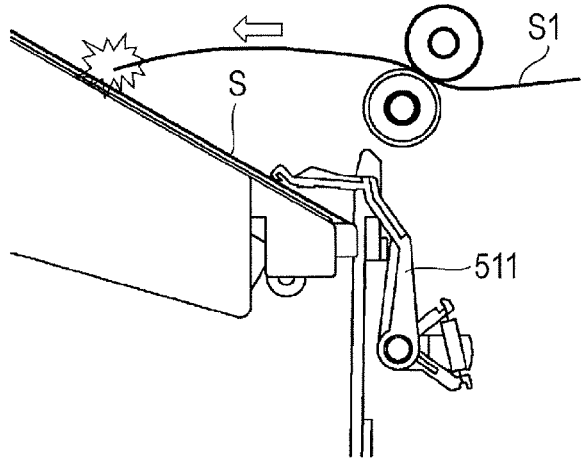
Figure 9C:
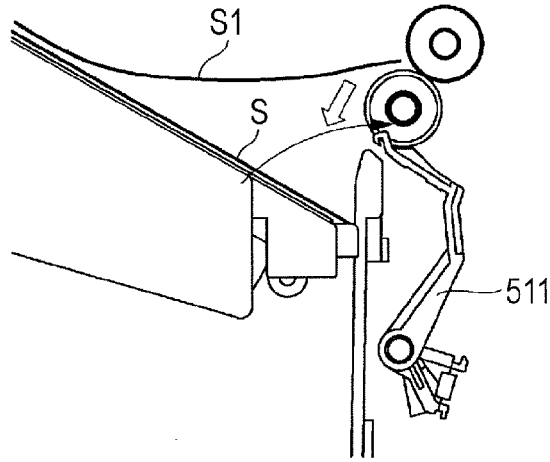

Next, a series of operations in which the sheets S or the sheet bundles on the stacking tray 137 are pressed by the stacked sheet pressing unit 500 prior to the subsequent discharge of the sheet S or the sheet bundle is described. For example, when the sheets S on the stacking tray 137 are pressed, first, as illustrated in FIG. 9A, the pressing portion 510 is pivoted up to a position at which the pressing portion 510 presses the sheets S before a sheet S1 to be discharged collides against the stacked sheets S. With this, the sheets S on the stacking tray 137 are pressed by the pressing portion 510. Then, as illustrated in FIG. 9B, even when the sheet S1 to be discharged collides against the stacked sheets S, the stacked sheets S are prevented from being pushed out by the sheet S1 to be discharged. The sheet S1 drops from above the pressing portion 510. Thus, immediately before the discharge of the sheet S1 is completed, the pressing portion 510 is moved to a retreat position (home position) as illustrated in FIG. 9C so as not to come into contact with the sheet S1.

Figure 10:
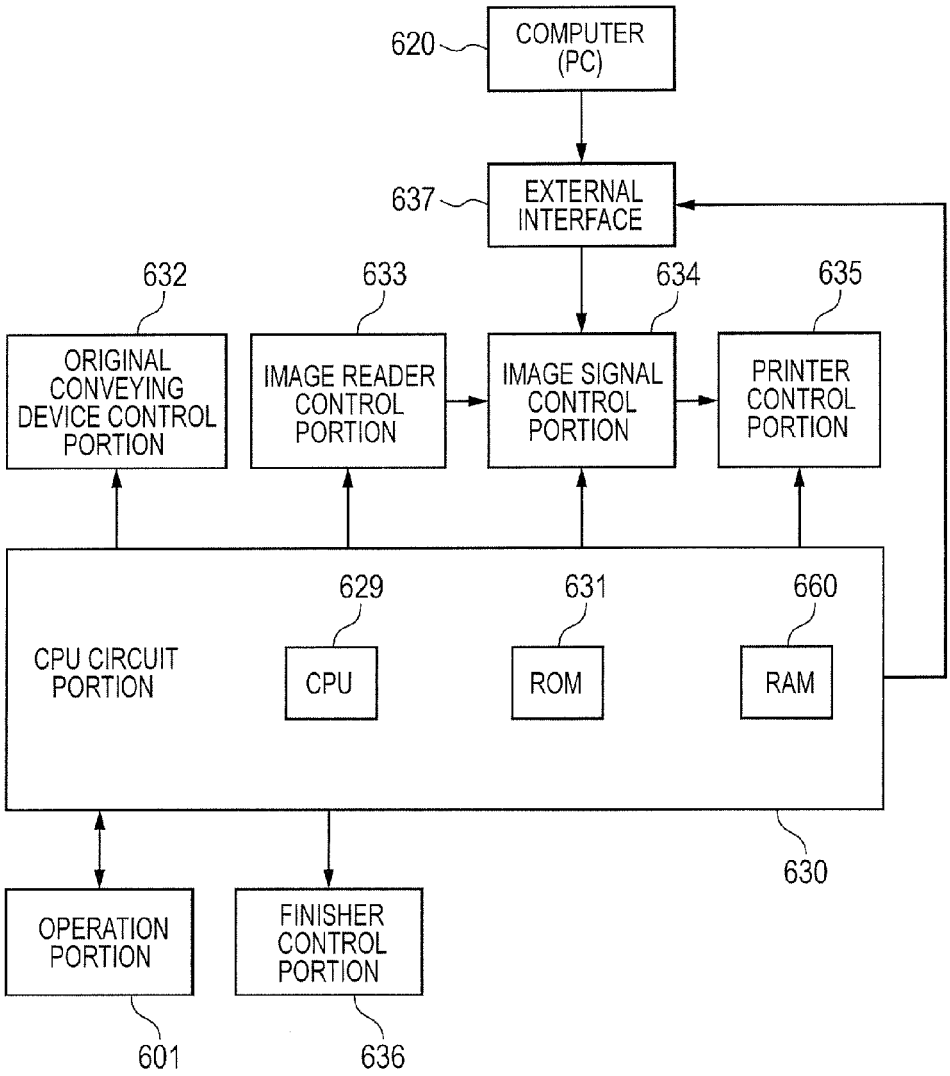
FIG. 10 is a control block diagram of the monochrome/full-color copying machine.

FIG. 10 is a control block diagram of the monochrome/full-color copying machine 600. The CPU circuit portion 630 includes a CPU 629, a ROM 631 storing control programs and the like, and a RAM 660 used as an area for temporarily storing control data or as a work area for computing associated with control. In FIG. 10, when receiving print data from an external PC 620, an external interface 637 connecting the monochrome/full-color copying machine 600 and the external PC (computer) 620 to each other develops the received data into a bit-mapped image, and outputs the bit-mapped image as image data to an image signal control portion 634.

The image signal control portion 634 outputs the data to a printer control portion 635, and the printer control portion 635 outputs data from the image signal control portion 634 to an exposure control portion (not shown). An image reader control portion 633 outputs an image of an original read by the image sensor 650*a* (refer to FIG. 1) to the image signal control portion 634, and the image signal control portion 634 outputs the output image to the printer control portion 635.

The operation portion 601 includes multiple keys for setting various functions of image formation, a display portion for displaying setting conditions, and the like. Key signals corresponding to operations of the keys by a user are output to the CPU circuit portion 630, and in response to signals from the CPU circuit portion 630, information corresponding to the signals is displayed on the display portion.

Based on the control programs stored in the ROM 631 and the settings from the operation portion 601, the CPU circuit portion 630 controls the image signal control portion 634, and the original conveying device 651 (refer to FIG. 1) via an original conveying device control portion 632. The CPU circuit portion 630 also controls the original reading portion 650 (refer to FIG. 1) via the image reader control portion 633, the image forming portion 603 (refer to FIG. 1) via the printer control portion 635, and the finisher 100 via the finisher control portion 636.

In this embodiment, the finisher control portion 636 is provided to the finisher 100, and drives and controls the finisher 100 through exchange of information with the CPU circuit portion 630. The finisher control portion 636 may be arranged integrally with the CPU circuit portion 630 on the copying machine main body 602 side so that the finisher 100 is directly controlled from the copying machine main body 602 side.

Figure 11:
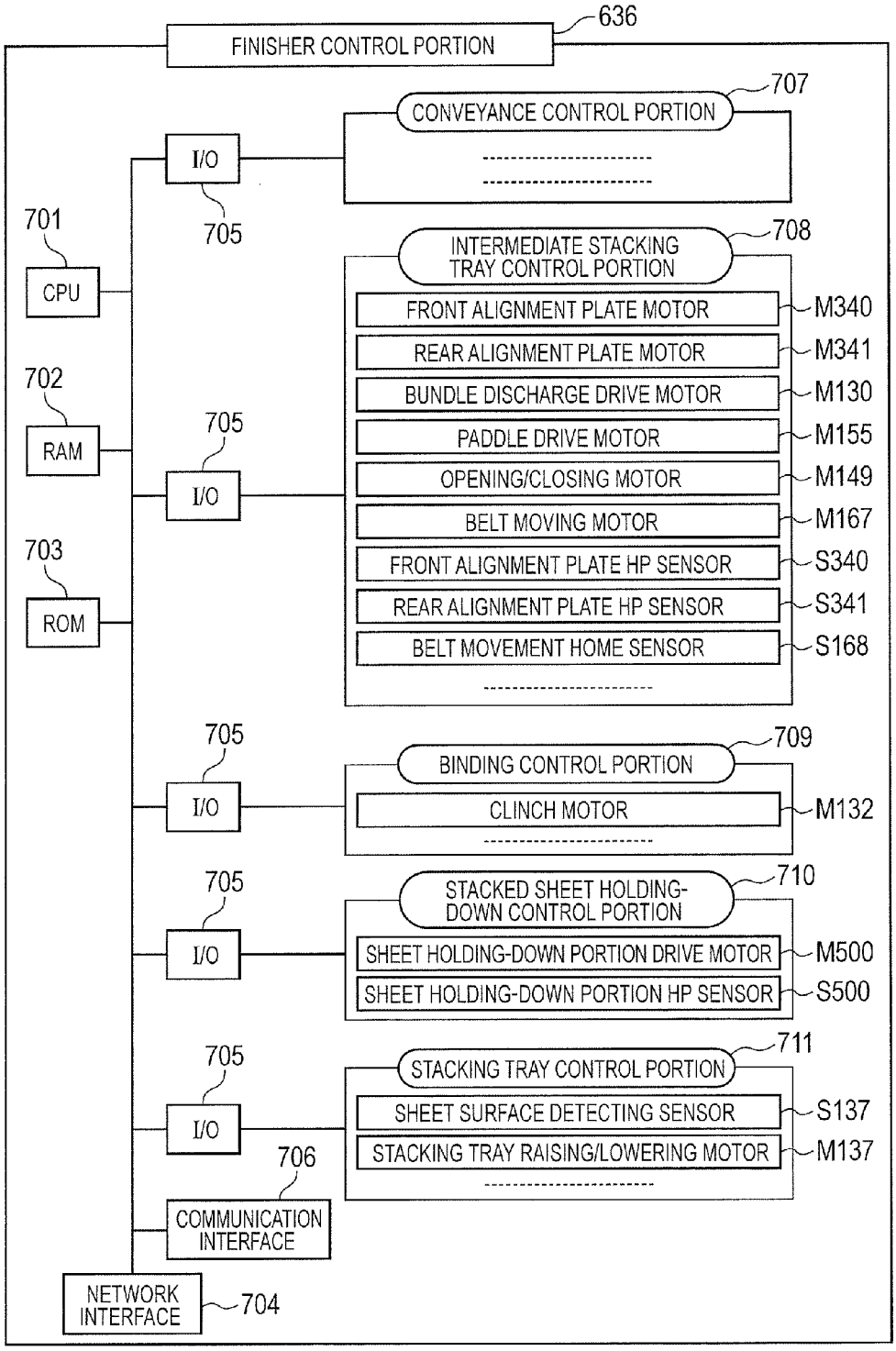
FIG. 11 is a control block diagram of the finisher.

FIG. 11 is a control block diagram of the finisher 100 according to this embodiment. The finisher control portion 636 includes a CPU (microcomputer) 701, a RAM 702, a ROM 703, input/output portions (I/O) 705, and a communication interface 706, and a network interface 704. A conveyance control portion 707, an intermediate stacking tray control portion 708, and a binding control portion 709 are connected to the input/output portions (I/O) 705. The conveyance control portion 707 controls a lateral registration detection process on the sheets S, a sheet buffering process, and a conveying process.

The intermediate stacking tray control portion 708 controls operations of the front alignment plate 340 and the rear alignment plate 341, operations of the draw-in paddles 131, moving operations of the belt rollers 158, and an opening/closing operation of the opening/closing guide 149. A front alignment plate home position (HP) sensor S340, a rear alignment plate HP sensor S341, the belt movement home sensor S168, and the like are connected to the intermediate stacking tray control portion 708. In response to signals from those sensors, the intermediate stacking tray control portion 708 drives and controls the front alignment plate motor M340, the rear alignment plate motor M341, the paddle drive motor M155, the bundle discharge drive motor M130, the opening/closing motor M149, the belt moving motor M167, and the like. The binding control portion 709 drives and controls the clinch motor M132 and the like so as to control the binding process performed by the stapler 132.

A stacked sheet pressing control portion 710 controls a pressing process which is performed by the stacked sheet pressing unit 500 with respect to the sheets S on the stacking tray 137. In response to a signal from the sheet pressing portion HP sensor S500, the stacked sheet pressing control portion 710 controls a drive of the sheet pressing portion drive motor M500 so as to control a pivoting position of the pressing portion 510.

A stacking tray control portion 711 drives a stacking tray raising/lowering motor M137 as a raising/lowering portion so as to control raising processes and lowering processes of the upper tray 136 and the stacking tray 137. The stacking tray control portion 711 drives the stacking tray raising/lowering motor M137 in response to a signal from a sheet surface detecting sensor S137 as a detecting portion configured to detect a stacking height of the upper surface of the uppermost sheet or the sheet bundles stacked on the stacking tray 137 so as to control a position of the stacking tray 137.

Figure 12:
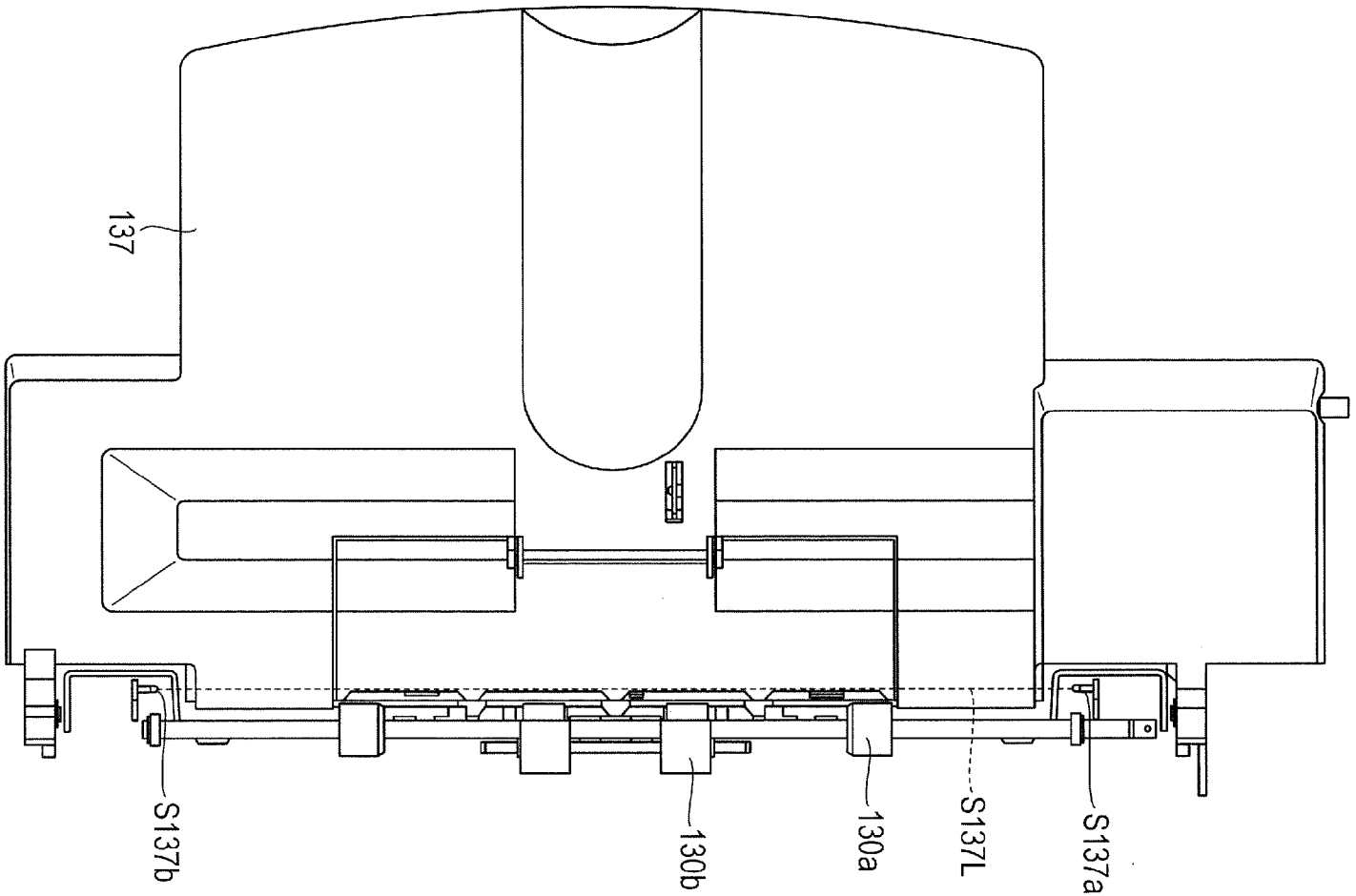
FIG. 12 illustrates a structure of a sheet surface detecting sensor provided to the staple portion.

In this embodiment, as illustrated in FIG. 12, the sheet surface detecting sensor S137 includes a light emitting portion S137*a* and a light receiving portion S137*b* arranged respectively on the rear side and the front side with respect to the stacking tray 137. The sheet surface detecting sensor S137 detects edge portions on the regulating member side of the sheets S stacked on the stacking tray 137, in other words, an upper surface position at an upstream edge portion in the sheet discharge direction. In this way, a stacking height at the upstream edge portion in the sheet discharge direction of the sheets S or the sheet bundles is detected.

Figure 13:
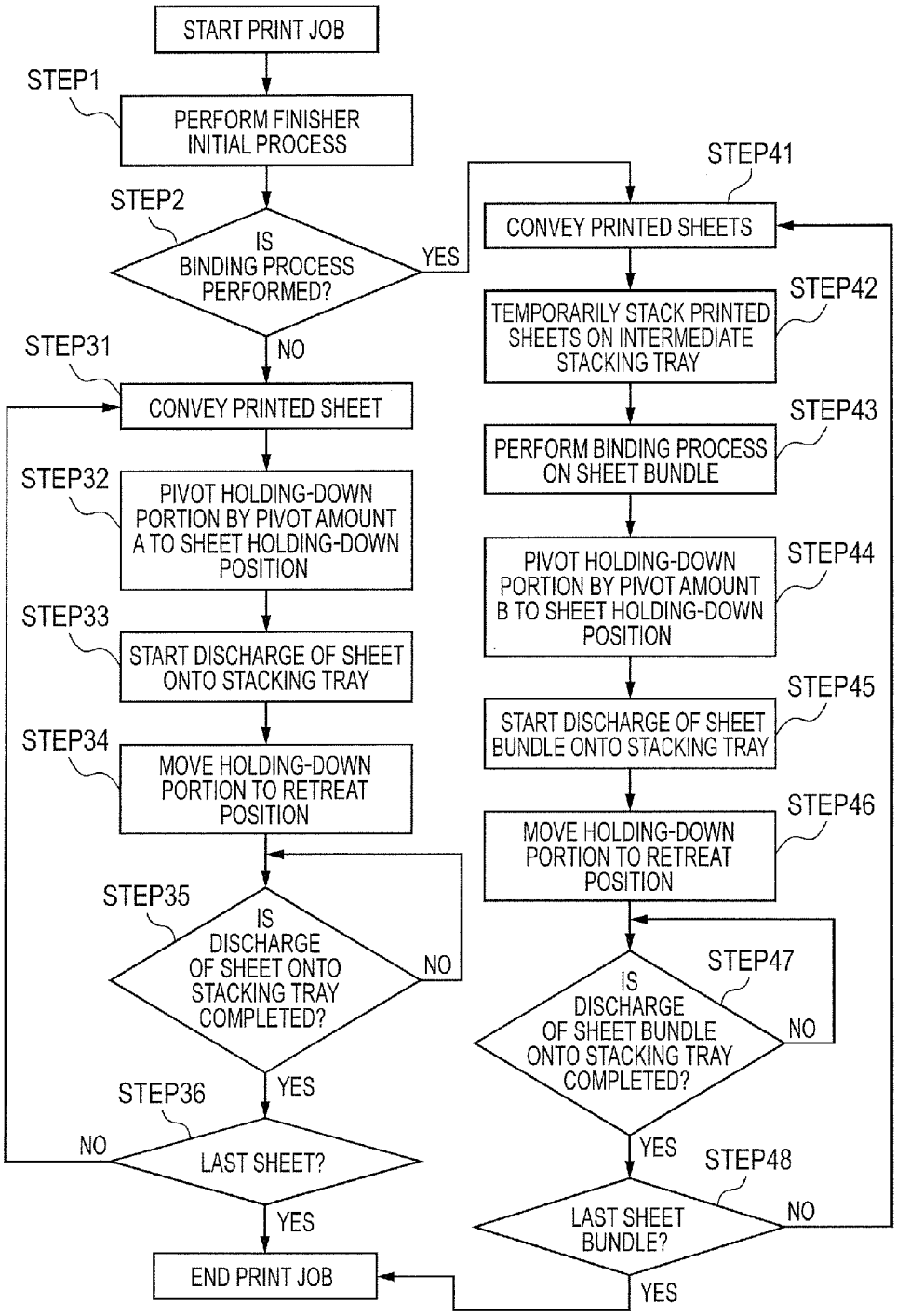
FIG. 13 is a flowchart illustrating how the series of sheet pressing operations performed by the stacked sheet pressing unit at a time of discharge of a sheet or a sheet bundle is controlled.

Next, how the series of operations in which the sheets S or the sheet bundles on the stacking tray 137 are pressed by the stacked sheet pressing unit 500 according to this embodiment is controlled is described. First, with reference to the flowchart of FIG. 13, how the series of sheet pressing operations at the time of the discharge of the sheet S or the sheet bundle is controlled is described.

When a print job is started, first, whether or not drive parts of the finisher 100 are located at respective predetermined home positions is monitored. An initial process, in which a drive part which is not located at its home position is moved to its home position, is performed (STEP 1). Next, after completion of the initial process, it is determined whether or not the binding process is performed in the print job (STEP 2). When the binding process is not performed in the print job (NO in STEP 2), a printed sheet S is conveyed to the bundle discharge roller pair 130 through the path in the sheet processing apparatus (STEP 31).

Next, the sheet pressing portion drive motor M500 is driven before the sheet discharge by the bundle discharge roller pair 130 is started so that, as illustrated in FIG. 9A, the pressing portion 510 is moved to the position at which the pressing portion 510 presses the sheet S on the stacking tray 137 (STEP 32). At this time, a pivot amount A of the pressing portion 510 by the sheet pressing portion drive motor M500, in other words, the pivot amount of the pressing portion 510 in the case of discharging the unbound sheets S is set so as to pivot to the line P1 in FIG. 19B. In still other words, when the binding process is not performed in the print job, the finisher control portion 636 causes the pressing portion 510 to be pivoted by the pivot amount A. Then, the sheet S1 starts to be discharged onto the stacking tray 137 (STEP 33). When the sheet S1 is discharged in this way, as illustrated in FIG. 9B, a leading edge of the sheet S1 collides against the sheets S stacked on the stacking tray 137. However, the sheets S are pressed by the pressing portion 510, and hence not pushed out.

Next, the discharged sheet S1 drops from above the pressing portion 510. Thus, immediately before the discharge of the sheet S1 is completed, the pressing portion 510 is moved to the retreat position (home position) as illustrated in FIG. 9C (STEP 34). Then, after the discharge of the sheet S1 onto the stacking tray 137 is completed (YES in STEP 35), it is determined whether or not the sheet S1 is the last sheet (STEP 36). When the sheet S1 is not the last sheet (NO in STEP 36), in other words, there exist subsequent sheets, the flow returns to STEP 31 so as to convey the subsequent sheets. When the sheet S1 is the last sheet (YES in STEP 36), the print job is ended.

When the binding process is performed in the print job (YES in STEP 2), printed sheets S are conveyed to the bundle discharge roller pair 130 through the path in the sheet processing apparatus (STEP 41). Then, the sheets S are temporarily stacked on the intermediate stacking tray 138 (STEP 42). When a predetermined number of sheets S are temporarily stacked on the intermediate stacking tray 138 and a sheet bundle is formed, the binding process is performed on the sheet bundle with the stapler 132 (STEP 43).

Figure 14A:
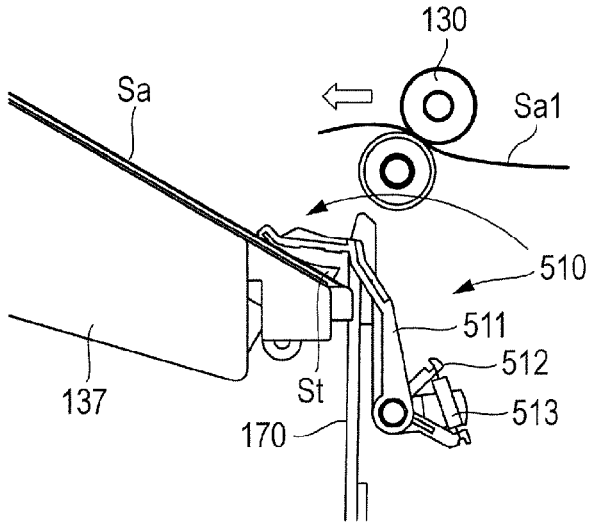
FIGS. 14A, 14B and 14C illustrate the operations performed by the stacked sheet pressing unit to press the sheet bundle on the stacking tray before a subsequent sheet bundle is discharged.

Next, the sheet pressing portion drive motor M500 is driven so that, as illustrated in FIG. 14A, the pressing portion 510 is moved to the position at which an upper surface of a sheet bundle Sa on the stacking tray 137, which is spaced further apart from the stacking wall 170 than a bound edge portion St (one edge portion in a sheet conveying direction), is pressed from the top (STEP 44). At this time, a pivot amount B of the pressing portion 510 by the sheet pressing portion drive motor M500, in other words, the pivot amount of the pressing portion 510 in a case of discharging a bound sheet bundle is set so as to pivot to the line P2 in FIG. 19B. In still other words, when the bound sheet bundle is pressed, the finisher control portion 636 causes the pressing portion 510 to be pivoted by the pivot amount B larger than the pivot amount A in the case of pressing the sheets S. In yet other words, in this embodiment, the pivot amount A and the pivot amount B have a relationship of pivot amount A<pivot amount B.

Figure 14B:
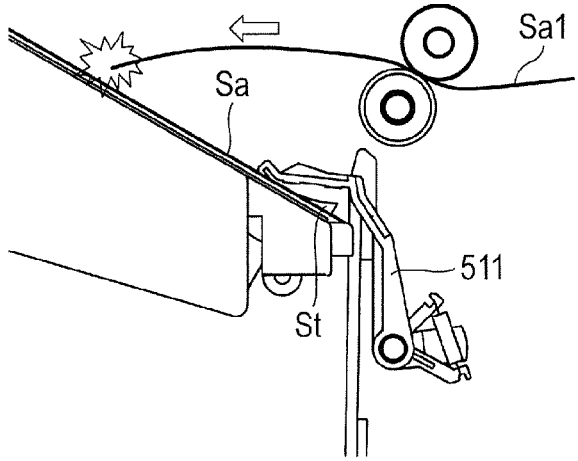
Figure 14C:
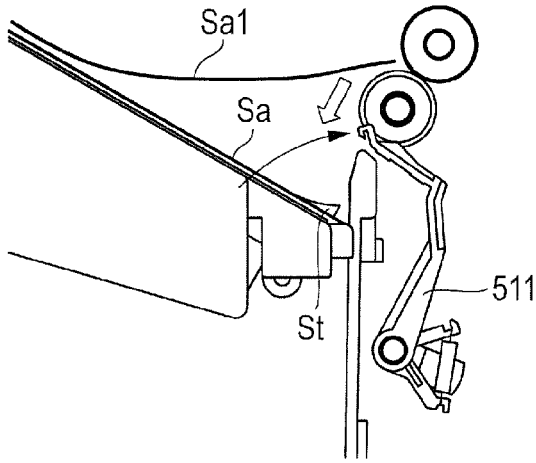

Then, a sheet bundle Sa1 starts to be discharged onto the stacking tray 137 (STEP 45). When the sheet bundle Sa1 is discharged in this way, as illustrated in FIG. 14B, a leading edge of the sheet bundle Sa1 collides against the sheet bundle Sa stacked on the stacking tray 137. However, the sheet bundle Sa is pressed by the pressing portion 510, and hence not pushed out. Next, the discharged sheet bundle Sa1 drops from above the pressing portion 510. Thus, immediately before the discharge of the sheet bundle Sa1 is completed, the pressing portion 510 is moved to the retreat position (home position) as illustrated in FIG. 14C (STEP 46). Then, after the discharge of the sheet bundle Sa1 onto the stacking tray 137 is completed (YES in STEP 47), it is determined whether or not the sheet bundle Sa1 is the last sheet bundle (STEP 48). When the sheet bundle Sa1 is not the last sheet bundle (NO in STEP 48), in other words, there exist subsequent sheet bundle, the flow returns to STEP 41 so as to convey the subsequent sheet bundle. When the sheet bundle Sa1 is the last sheet bundle (YES in STEP 48), the print job is ended.

In this embodiment, the pivot amount of the pressing portion 510 in the case of pressing the sheet bundles subjected to the binding process is larger than the pivot amount (lowering amount) of the pressing portion 510 in the case of pressing the sheets. With this, the sheet bundles subjected to the binding process and the sheets not subjected to the binding process can be pressed respectively at appropriate height positions without applying an excessive force. As a result, when both the sheet bundles subjected to the binding process and the sheets not subjected to the binding process are stacked on the stacking tray 137, the stacked preceding sheets and the stacked preceding sheet bundles can be prevented from being pushed out by the discharge of the sheet or the sheet bundle. Thus, the sheets or the sheet bundles can be stacked in neat alignment.

As described above, the pivot amount of the pressing portion 510 in the case of pressing the bound sheet bundles Sa is set to be larger than the pivot amount of the pressing portion 510 in the case of pressing the sheets S. With this, stacking performance of the sheets S and S1 and the bound sheet bundles Sa and Sa1 discharged on the stacking tray 137 can be enhanced. In other words, when the sheet bundles Sa are discharged onto the stacking tray 137, the pressing portion 510 exerts a pressing force (lowering amount) higher than that in the case where the sheets S are discharged. With this, stacking performance of the sheets S and S1 and the sheet bundles Sa and Sa1 discharged on the stacking tray 137 can be enhanced.

In the above description, when the binding process is performed in the print job, the pressing portion 510 is pivoted by the fixed pivot amount B. However, the present invention is not limited thereto. For example, when the binding process is performed in the print job, the pressing force (pivot amount) of the pressing portion 510 may be changed in accordance with the number of sheet bundles Sa to be subjected to the binding process or the number of sheets S to be formed into the sheet bundles Sa to be subjected to the binding process.

Figure 15:
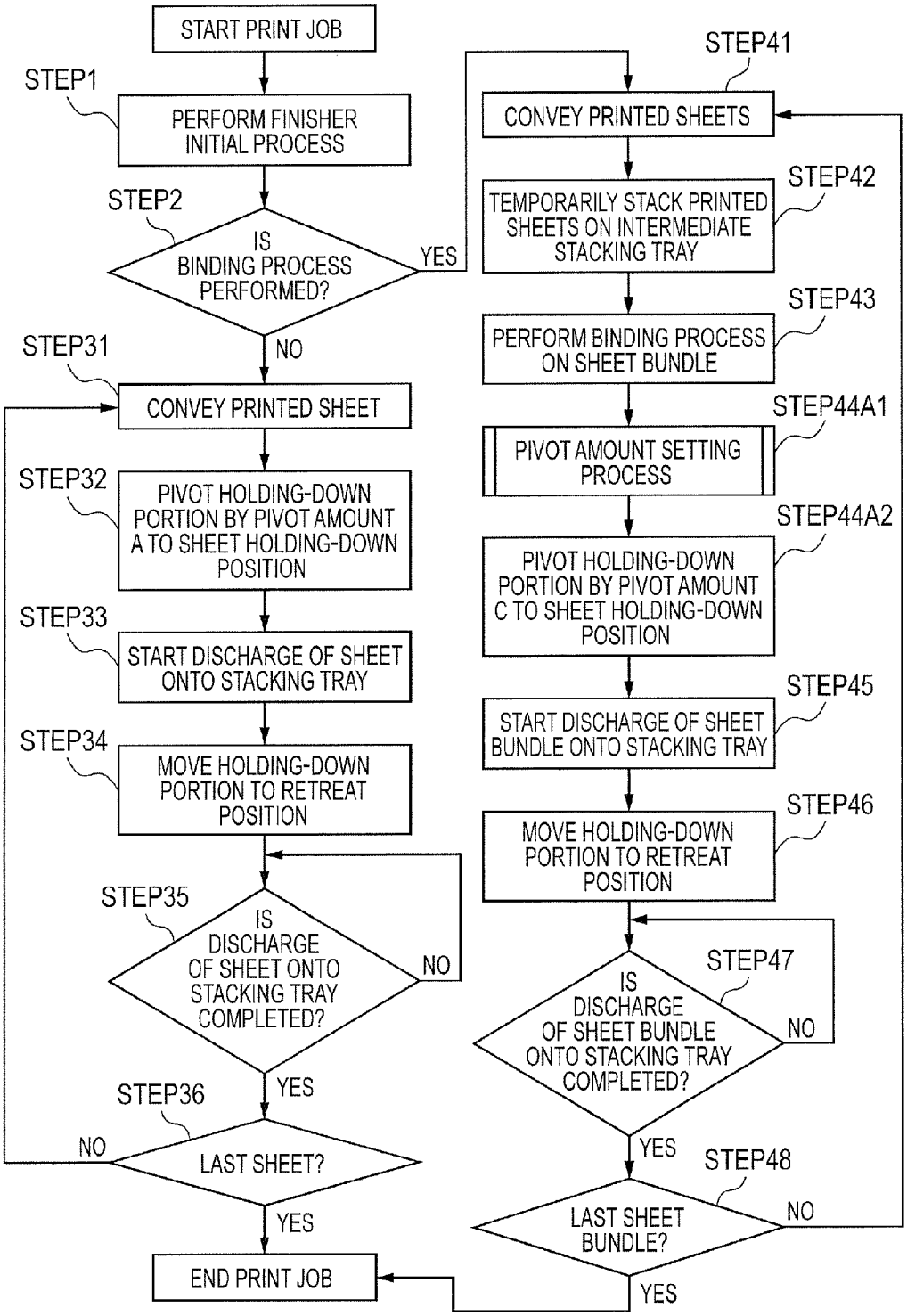
FIG. 15 is a flowchart illustrating how a series of sheet pressing operations performed by a stacked sheet pressing unit provided to a sheet processing apparatus as an example of a sheet stacking apparatus according to a second embodiment of the present invention is controlled at the time of discharge of a sheet.

Next, a second embodiment of the present invention is described. In the second embodiment, the pressing force (pivot amount) of the pressing portion 510 is changed in accordance with the number of the sheet bundles Sa to be subjected to the binding process. FIG. 15 is a flowchart illustrating how the series of sheet pressing operations performed by the stacked sheet pressing unit 500 provided to a sheet processing apparatus as an example of a sheet stacking apparatus according to this embodiment is controlled at the time of discharge of the sheet. In FIG. 15, the processes of STEP 31 to STEP 36 in the case where the binding process is not performed in the print job (NO in STEP 2) are the same as the processes illustrated in FIG. 13 above, and hence description thereof is omitted.

When the binding process is performed in the print job (YES in STEP 2), printed sheets S are conveyed to the bundle discharge roller pair 130 through the path in the sheet processing apparatus (STEP 41). Then, the sheets S are temporarily stacked on the intermediate stacking tray 138 (STEP 42). When a predetermined number of sheets S are temporarily stacked on the intermediate stacking tray 138 and a sheet bundle is formed, the binding process is performed on the sheet bundle with the stapler 132 (STEP 43).

Figure 16:
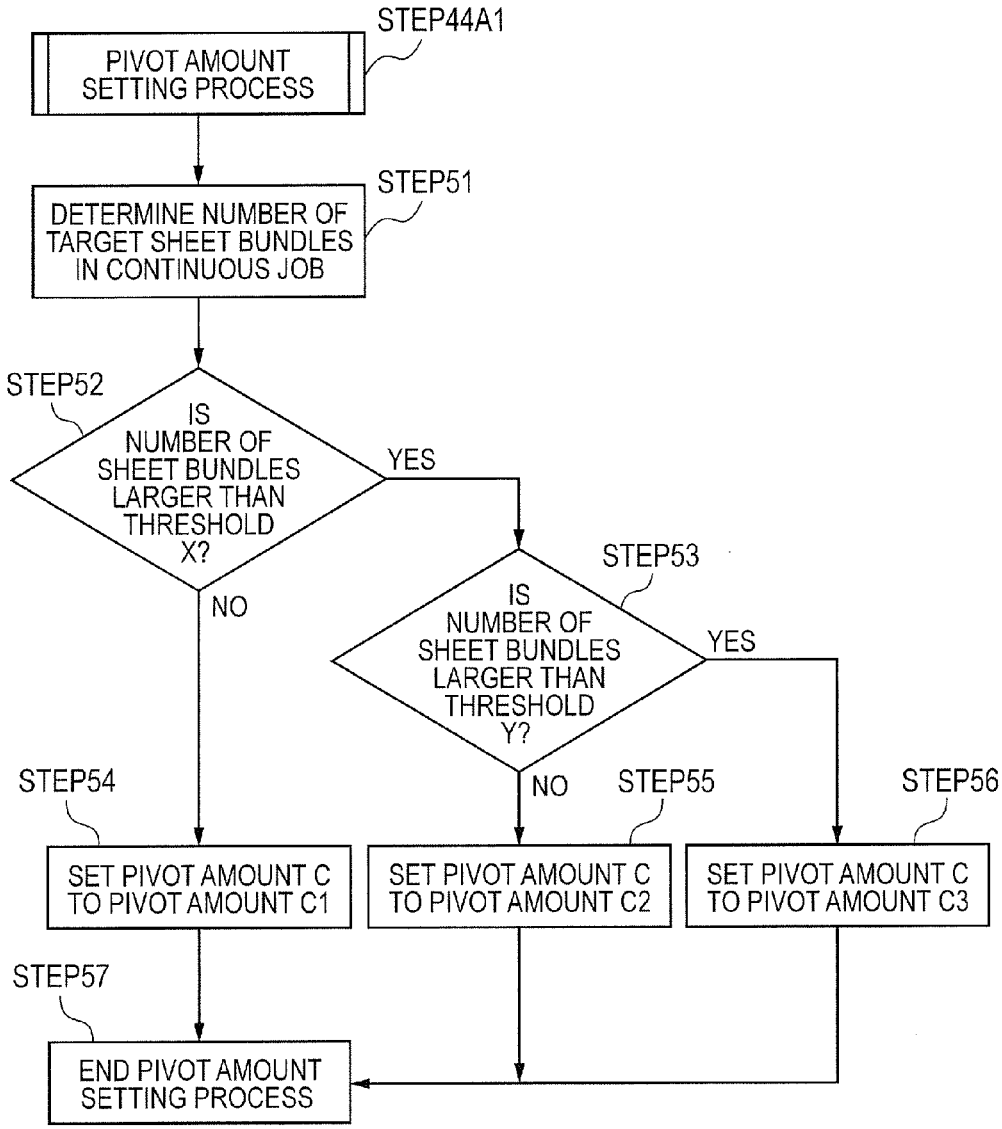
FIG. 16 is a flowchart illustrating a pivot amount setting process on a pressing member of the stacked sheet pressing unit in accordance with the number of stacked sheet bundles to be bound.
Figure 19A:
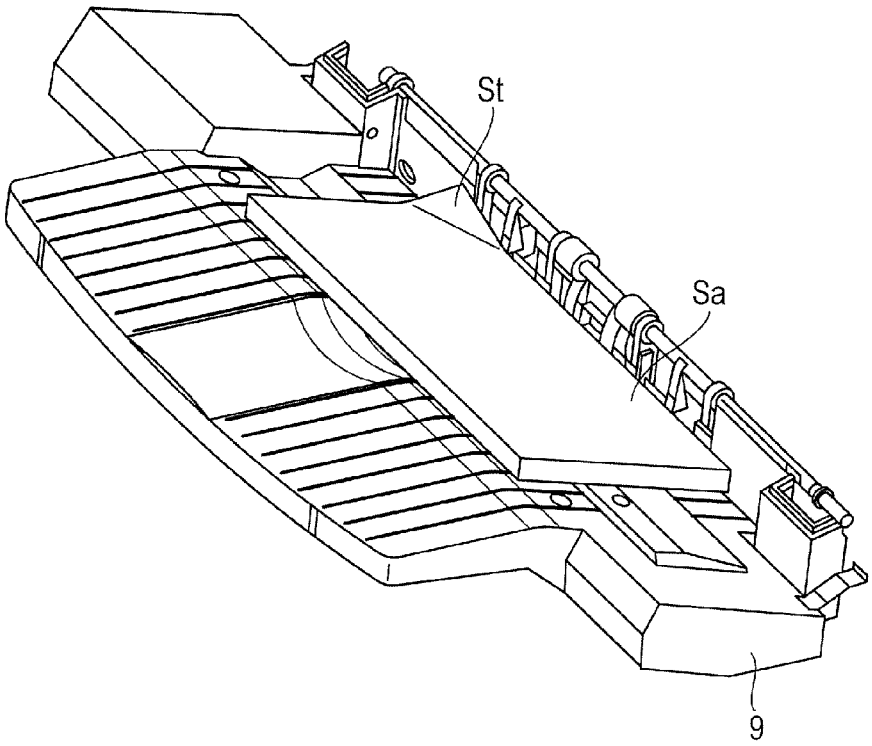
FIGS. 19 A and 19B illustrate a problem of an example of a conventional sheet stacking apparatus.
Figure 19B:
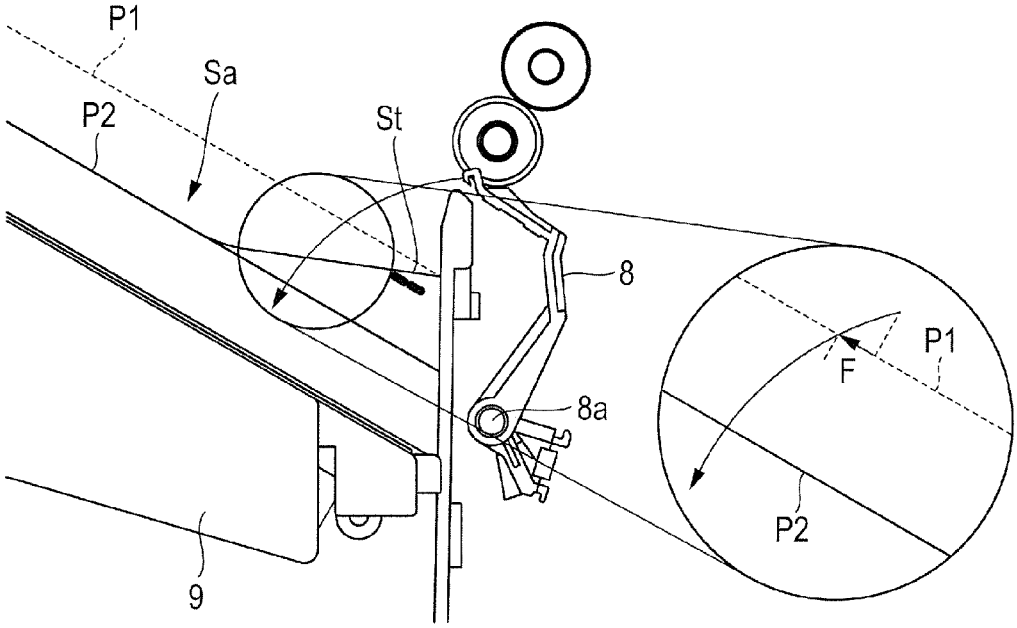

When the bound sheet bundles Sa are stacked, an interval between the line P1 and the line P2 illustrated in FIG. 19B becomes larger as the number of stacked bound sheet bundles Sa increases. Thus, it is necessary to press the sheet bundles Sa with an appropriate pressing force (pivot amount) in accordance with the number of stacked bound sheet bundles Sa. Thus, after the binding process is completed, the flow proceeds to a pivot amount setting process illustrated in FIG. 16 (STEP 44A1). In the pivot amount setting process, first, based on the information from the copying machine main body 602, the number of target sheet bundles Sa processed immediately previously in the continuous job is determined (STEP 51). Then, it is determined whether or not the number of target sheet bundles Sa is larger than a preset threshold X (STEP 52). When the number of target sheet bundles Sa is smaller than the threshold X (NO in STEP 52), a pivot amount C of the pressing portion 510 is set to a preset pivot amount C1, which is larger than the pivot amount A (STEP 54).

When the number of target sheet bundles Sa is larger than the threshold X (YES in STEP 52), it is determined whether or not the number of target sheet bundles Sa is larger than a threshold Y (STEP 53). The threshold Y is a preset value similarly to the threshold X, and has a relationship of X<Y. When the number of target sheet bundles Sa is smaller than the threshold Y (NO in STEP 53), in other words, when a number Z of sheet bundles is set in a relationship of X<z<Y, the pivot amount C of the pressing portion 510 is set to a preset pivot amount C2, which is larger than the pivot amount C1 (STEP 55). Meanwhile, when the number Z of sheet bundles is larger than the threshold Y (YES in STEP 53), the pivot amount C of the pressing portion 510 is set to a preset pivot amount C3, which is larger than the pivot amount C2 (STEP 56).

After the pivot amount C of the pressing portion 510 is set through such a pivot amount setting process in accordance with the number of target sheet bundles Sa, the pressing portion 510 is moved by the pivot amount C to the position at which the pressing portion 510 presses the sheet bundles Sa on the stacking tray 137 (STEP 44A2). Then, discharge of the sheet bundle Sa1 onto the lower stacking tray 137 is started (STEP 45). After that, the discharged sheet bundle Sa1 drops from above the pressing portion 510. Thus, immediately before the discharge of the sheet bundle Sa1 is completed, the pressing portion 510 is moved to the retreat position (home position) (STEP 46).

Then, after the discharge of the sheet bundle Sa1 onto the stacking tray 137 is completed (YES in STEP 47), whether or not the sheet bundle Sa1 is the last sheet is determined (STEP 48). When the sheet bundle Sa1 is not the last sheet (NO in STEP 48), in other words, there exists a subsequent sheet bundle, the flow returns to STEP 41 so as to convey the subsequent sheet bundle. When the sheet bundle Sa1 is the last sheet (YES in STEP 48), the print job is ended.

As described above, in this embodiment, the pivot amount C of the pressing portion 510 is increased as the number of stacked sheet bundles Sa increases. With this, even when the interval between the line P1 and the line P2 illustrated in FIG. 19B becomes larger, the sheet bundles Sa can be pressed with an appropriate pressing force (pivot amount) in accordance with the number of stacked sheet bundles Sa. In this embodiment, the two thresholds X and Y are set for the pivot amount C, but more thresholds may be set.

Figure 17:
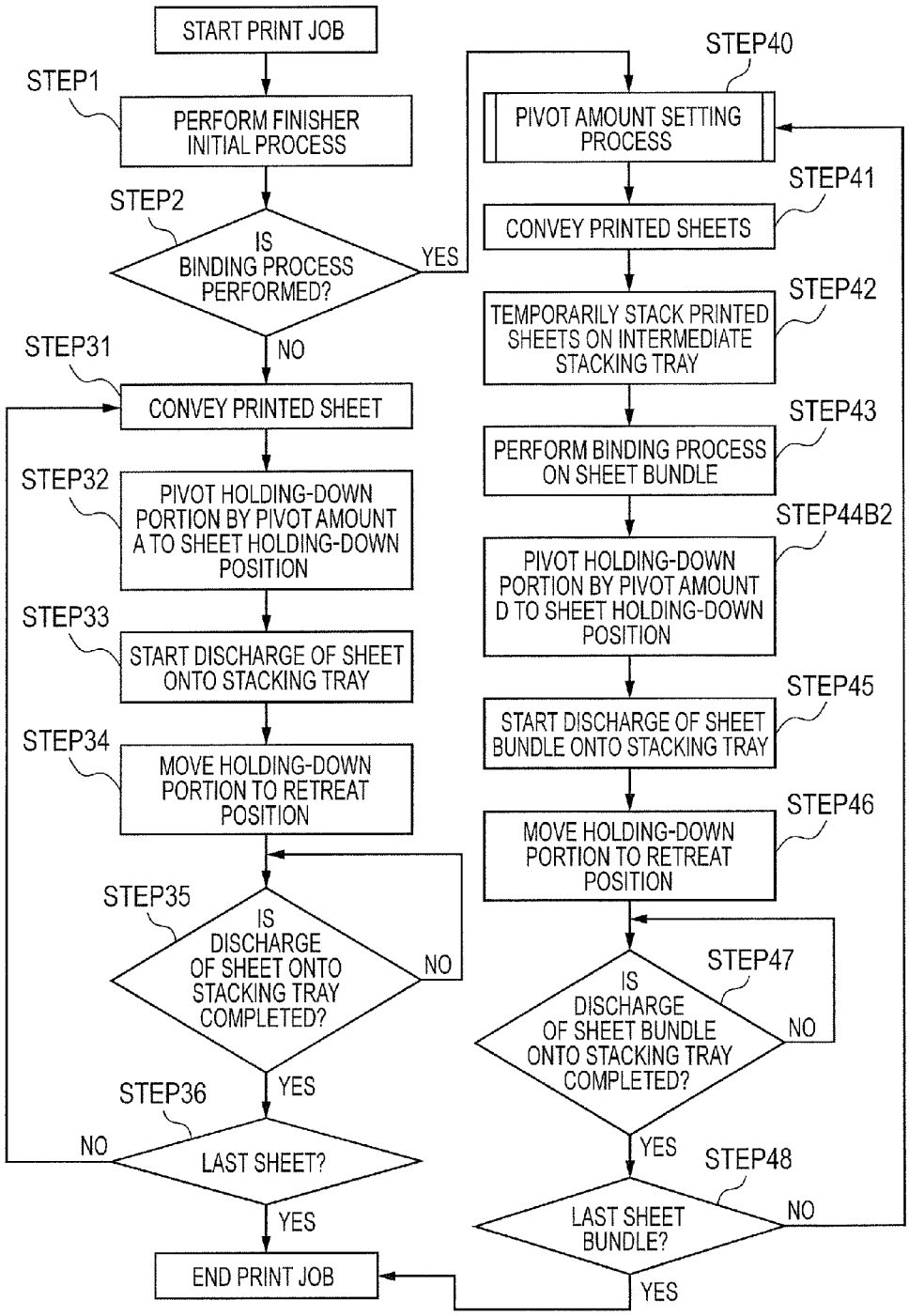
FIG. 17 is a flowchart illustrating how a series of sheet pressing operations performed by a stacked sheet pressing unit provided to a sheet processing apparatus as an example of a sheet stacking apparatus according to a third embodiment of the present invention is controlled at the time of discharge of a sheet.

Next, a third embodiment of the present invention is described. In the third embodiment, the pressing force (pivot amount) of the pressing portion 510 is changed in accordance with the number of sheets S to be formed into the sheet bundles Sa to be subjected to the binding process. FIG. 17 is a flowchart illustrating how the series of sheet pressing operations performed by the stacked sheet pressing unit 500 provided to a sheet processing apparatus as an example of a sheet stacking apparatus according to this embodiment is controlled at the time of discharge of the sheet. In FIG. 17, the processes of STEP 31 to STEP 36 in the case where the binding process is not performed in the print job (NO in STEP 2) are the same as the processes illustrated in FIG. 13 above, and hence description thereof is omitted.

Figure 18:
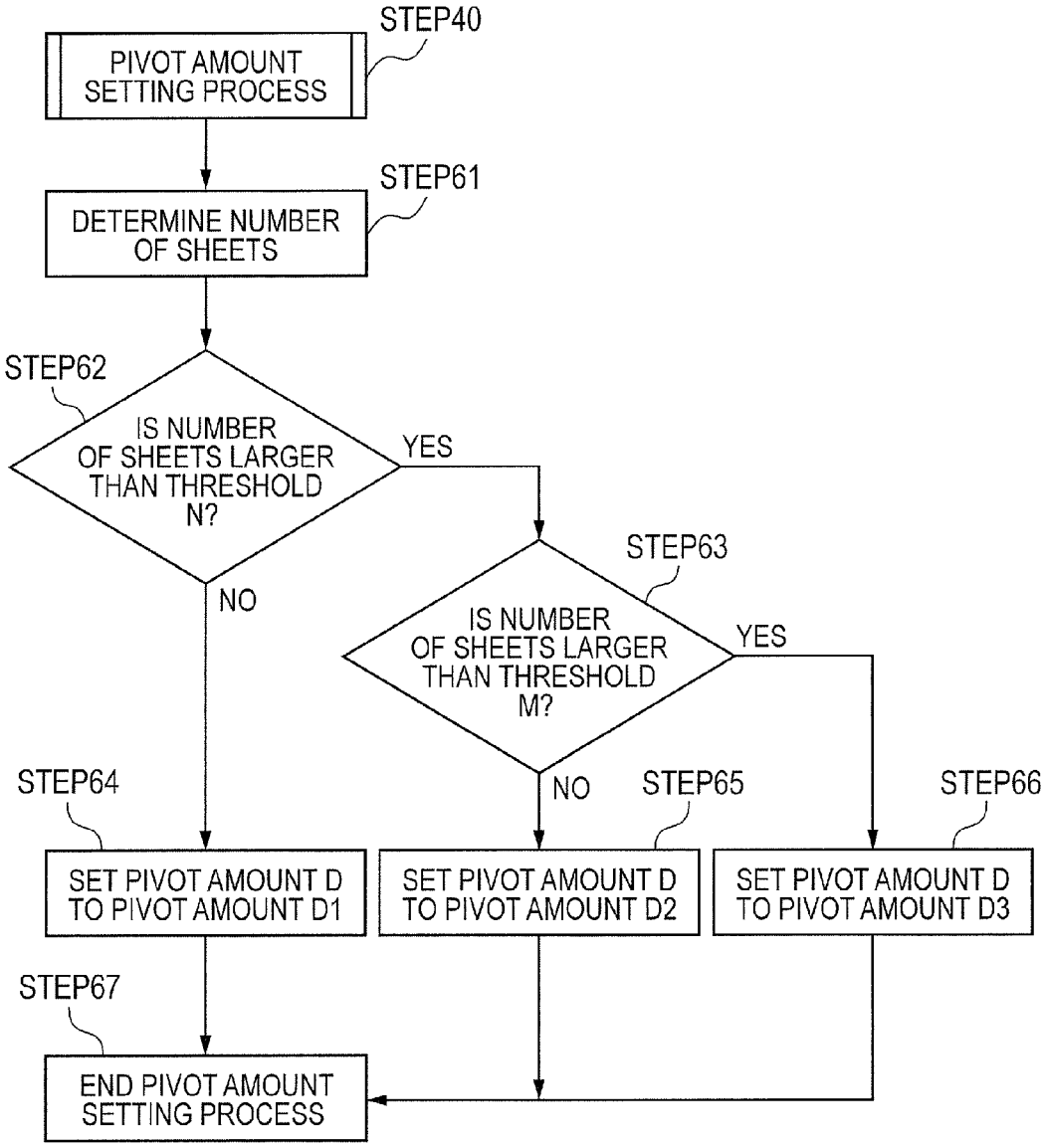
FIG. 18 is a flowchart illustrating a pivot amount setting process on a pressing member of the stacked sheet pressing unit in accordance with the number of sheets to form a sheet bundle.

When the bound sheet bundle Sa is discharged, as the number of sheets S of the bound sheet bundle Sa increases, a force of a subsequent sheet bundle Sa1, with which the stacked sheet bundles Sa are pushed out, becomes greater. Thus, it is necessary to press the bound sheet bundles Sa with an appropriate pressing force (pivot amount) in accordance with the number of sheets S of the bound sheet bundles Sa. Thus, when the binding process is performed in the print job (YES in STEP 2), the flow proceeds to a pivot amount setting process illustrated in FIG. 18 (STEP 40). In the pivot amount setting process, first, based on the information from the copying machine main body 602, or through counting with a counter, the number of sheets S to be subjected to the binding process is determined (STEP 61). Then, it is determined whether or not the number of sheets S of the sheet bundle Sa is larger than a preset threshold N (STEP 62). When the number of sheets S is smaller than the threshold N (NO in STEP 62), a pivot amount D of the pressing portion 510 is set to a preset pivot amount D1, which is larger than the pivot amount A (STEP 64).

When the number of sheets S of the sheet bundle Sa is larger than the threshold N (YES in STEP 62), it is determined whether or not the number of sheets S of the sheet bundle Sa is larger than a threshold M (STEP 63). The threshold M is a preset value similarly to the threshold N, and has a relationship of N<M. When the number of sheets S of the sheet bundle Sa is smaller than the threshold M (NO in STEP 63), in other words, when a number Z1 of sheets S of the sheet bundle Sa is set in a relationship of N<Z1<M, the pivot amount D of the pressing portion 510 is set to a preset pivot amount D2, which is larger than the pivot amount D1 (STEP 65). Further, when the number Z1 of sheets S of the sheet bundle Sa is larger than the threshold M (YES in STEP 63), the pivot amount D of the pressing portion 510 is set to a preset pivot amount D3, which is larger than the pivot amount D2 (STEP 66).

After the pivot amount D of the pressing portion 510 is set through the pivot amount setting process in accordance with the number of sheets S of the sheet bundle Sa, printed sheets S are conveyed to the bundle discharge roller pair 130 through the path in the sheet processing apparatus (STEP 41). Then, the sheets S are temporarily stacked on the intermediate stacking tray 138 (STEP 42). When a predetermined number of sheets S are temporarily stacked on the intermediate stacking tray 138 and a sheet bundle Sa is formed, the binding process is performed on the sheet bundle Sa with the stapler 132 (STEP 43).

Then, the pressing portion 510 is moved by the pivot amount D to the position at which the pressing portion 510 presses the sheet bundle Sa on the stacking tray 137 (STEP 44B2). Next, discharge of the sheet bundle Sa1 onto the stacking tray 137 is started (STEP 45). After that, the discharged sheet bundle Sa1 drops from above the pressing portion 510. Thus, immediately before the discharge of the sheet bundle Sa1 is completed, the pressing portion 510 is moved to the retreat position (home position) (STEP 46). Then, after the discharge of the sheet bundle Sa1 onto the stacking tray 137 is completed (YES in STEP 47), it is determined whether or not the sheet bundle Sa1 is the last sheet bundle (STEP 48). When the sheet bundle Sa1 is not the last sheet bundle (NO in STEP 48), in other words, there exist subsequent sheet bundle, the flow returns to STEP 41 so as to convey the subsequent sheet bundle. When the sheet bundle is the last sheet bundle (YES in STEP 48), the print job is ended.

As described above, in this embodiment, the pivot amount D of the pressing portion 510 is increased as the number of the sheets S of the sheet bundle Sa to be stacked increases. With this, even when the interval between the line P1 and the line P2 illustrated in FIG. 19B becomes larger, the sheet bundles Sa can be pressed with an appropriate pressing force (pivot amount) in accordance with the number of the sheets S of the sheet bundle Sa. In this embodiment, the two thresholds N and M are set for the pivot amount D, but more thresholds may be set.

In the above description, the pressing portion 510 is pivoted downward to press the sheets S or the sheet bundles Sa. However, the present invention is not limited thereto. For example, the pressing portion 510 may be provided to be capable of being raised and lowered in the vertical direction so that the pressing portion 510 may be lowered to press the sheets S or the sheet bundles Sa.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103016, filed Apr. 27, 2012, and Japanese Patent Application No. 2013-084297, filed Apr. 12, 2013, which are hereby incorporated by reference herein in their entirety.

What is claimed is:

1. A sheet stacking apparatus, comprising:

a sheet stacking portion on which a plurality of sheets is sequentially stacked;

a binding portion configured to perform a binding process on one edge portion in a sheet conveying direction of sheets stacked on the sheet stacking portion;

a discharge stacking portion onto which the sheets or a sheet bundle, formed from a plurality of sheets and subjected to the binding process in the binding portion, is discharged, the discharge stacking portion being capable of being raised and lowered;

a detecting portion configured to detect, on the one edge portion side, a stacking height of an upper surface of the sheets or the sheet bundle stacked on the discharge stacking portion;

a raising/lowering portion configured to raise and lower the discharge stacking portion;

a pressing portion which is movable, the pressing portion configured to press, from above, the sheets or the sheet bundle stacked on the discharge stacking portion;

a moving portion configured to lower the pressing portion so as to press, from above, the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion is configured to control, when the sheet bundle is discharged onto the discharge stacking portion, the moving portion so that the pressing portion presses the sheet bundle with a pressing force greater than a pressing force in a case where the sheets are discharged onto the discharge stacking portion.

2. A sheet stacking apparatus according to claim 1, wherein the control portion controls the moving portion so as to move the lowered pressing portion to a retreat position, where the discharge of a subsequent sheet or a subsequent sheet bundle is prevented from being hindered, prior to discharge of the subsequent sheet or the subsequent sheet bundle onto the discharge stacking portion.

3. A sheet stacking apparatus according to claim 1, wherein the pressing portion has a plurality of pressing portions provided along a width direction orthogonal to a discharge direction.

4. A sheet stacking apparatus according to claim 1, wherein the pressing portion comprises:

a support member provided to a shaft extending along a width direction orthogonal to a discharge direction; and a pressing member supported by the support member in a pivotable manner, and pivoted cooperatively with the support member through intermediation of a spring member which is interposed between the pressing member and the support member when the support member is rotated cooperatively with the shaft, and wherein the support member pivots cooperatively with the pressing member until the pressing member abuts against the upper surface of the sheets or the sheet bundle, and the support member further pivots the pressing member against the spring member after the pressing member abuts against the upper surface of the sheets or the sheet bundle so as to increase the pressing force for pressing the sheets or the sheet bundle.

5. A sheet stacking apparatus according to claim 1, wherein the control portion controls the moving portion so that the pressing force increases as a number of the sheet bundles increases.

6. A sheet stacking apparatus according to claim 1, wherein the control portion controls the moving portion so that the pressing force increases as a number of the sheets which form the sheet bundle increases.

7. An image forming apparatus, comprising:

an image forming portion configured to form an image on a plurality of sheets;

a sheet stacking portion on which the plurality of sheets having the image formed by the image forming portion is sequentially stacked;

a binding portion configured to perform a binding process on one edge portion in a sheet conveying direction of a sheet bundle which is formed from the plurality of sheets stacked on the sheet stacking portion;

a discharge stacking portion onto which the sheets or the sheet bundle which is subjected to the binding process in the binding portion is discharged;

a detecting portion configured to detect, on the one edge portion side, a stacking height of an upper surface of the sheets or the sheet bundle stacked on the discharge stacking portion;

a raising/lowering portion configured to raise and lower the discharge stacking portion;

a pressing portion which is movable, the pressing portion configured to press, from above, the sheets or the sheet bundle stacked on the discharge stacking portion;

a moving portion configured to lower the pressing portion so as to press, from above, the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion is configured to control, when the sheet bundle is discharged onto the discharge stacking portion, the moving portion so that the pressing portion presses the sheet bundle with a pressing force greater than a pressing force in a case where the sheets are discharged onto the discharge stacking portion.

8. An image forming apparatus according to claim 7, wherein the control portion controls the moving portion so as to move the lowered pressing portion to a retreat position, where the discharge of a subsequent sheet or a subsequent sheet bundle is prevented from being hindered, prior to discharge of the subsequent sheet or the subsequent sheet bundle onto the discharge stacking portion.

9. An image forming apparatus according to claim 7, wherein the pressing portion has a plurality of pressing portions provided along a width direction orthogonal to a discharge direction.

10. An image forming apparatus according to claim 7, wherein the pressing portion comprises:

a support member provided to a shaft extending along a width direction orthogonal to a discharge direction; and a pressing member supported by the support member in a pivotable manner, and pivoted cooperatively with the support member through intermediation of a spring member which is interposed between the pressing member and the support member when the support member is rotated cooperatively with the shaft, and wherein the support member pivots cooperatively with the pressing member until the pressing member abuts against the upper surface of the sheets or the sheet bundle, and the support member further pivots the pressing member against the spring member after the pressing member abuts against the upper surface of the sheets or the sheet bundle so as to increase the pressing force for pressing the sheets or the sheet bundle.

11. An image forming apparatus according to claim 7, wherein the control portion controls the moving portion so that the pressing force increases as a number of the sheet bundles increases.

12. An image forming apparatus according to claim 7, wherein the control portion controls the moving portion so that the pressing force increases as a number of the sheets which form the sheet bundle increases.

13. A sheet stacking apparatus, comprising:

a sheet stacking portion on which a plurality of sheets is sequentially stacked;

a binding portion configured to perform a binding process on one edge portion in a sheet conveying direction of sheets stacked on the sheet stacking portion;

a discharge stacking portion onto which the sheets or a sheet bundle, formed from a plurality of sheets and subjected to the binding process in the binding portion, is discharged, the discharge stacking portion being capable of being raised and lowered;

a detecting portion configured to detect, on the one edge portion side, a stacking height of an upper surface of the sheets or the sheet bundle stacked on the discharge stacking portion;

a raising/lowering portion configured to raise and lower the discharge stacking portion;

a pressing portion which is movable, the pressing portion configured to press, from above, the sheets or the sheet bundle stacked on the discharge stacking portion;

a moving portion configured to lower the pressing portion so as to press, from above, the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion is configured to control, when the sheet bundle is discharged onto the discharge stacking portion, the moving portion so that a lowering amount of the pressing portion to press the sheet bundle is larger than a lowering amount of the pressing portion in a case where the sheets are discharged onto the discharge stacking portion.

14. A sheet stacking apparatus according to claim 13, wherein the control portion controls the moving portion so as to move the lowered pressing portion to a retreat position, where the discharge of a subsequent sheet or a subsequent sheet bundle is prevented from being hindered, prior to discharge of the subsequent sheet or the subsequent sheet bundle onto the discharge stacking portion.

15. A sheet stacking apparatus according to claim 13, wherein the pressing portion comprises:

a support member provided to a shaft extending along a width direction orthogonal to a discharge direction; and a pressing member supported by the support member in a pivotable manner, and pivoted cooperatively with the support member through intermediation of a spring member which is interposed between the pressing member and the support member when the support member is rotated cooperatively with the shaft, and wherein the support member pivots cooperatively with the pressing member until the pressing member abuts against the upper surface of the sheets or the sheet bundle, and the support member further pivots the pressing member against the spring member after the pressing member abuts against the upper surface of the sheets or the sheet bundle so as to increase a pressing force for pressing the upper surface of the sheets or the sheet bundle.

16. A sheet stacking apparatus according to claim 13, wherein the control portion controls the moving portion so that the lowering amount of the pressing portion increases as a number of the sheet bundles increases.

17. A sheet stacking apparatus according to claim 13, wherein the control portion controls the moving portion so that the lowering amount of the pressing portion increases as a number of the sheets which form the sheet bundle increases.

18. An image forming apparatus, comprising:

an image forming portion configured to form an image on a plurality of sheets;

a sheet stacking portion on which the plurality of sheets having the image formed by the image forming portion is sequentially stacked;

a binding portion configured to perform a binding process on one edge portion in a sheet conveying direction of a sheet bundle which is formed from the plurality of sheets stacked on the sheet stacking portion;

a discharge stacking portion onto which the sheets or the sheet bundle which is subjected to the binding process in the binding portion is discharged;

a detecting portion configured to detect, on the one edge portion side, a stacking height of an upper surface of the sheets or the sheet bundle stacked on the discharge stacking portion;

a raising/lowering portion configured to raise and lower the discharge stacking portion;

a pressing portion which is movable, the pressing portion configured to press, from above, the sheets or the sheet bundle stacked on the discharge stacking portion;

a moving portion configured to lower the pressing portion so as to press, from above, the sheets or the sheet bundle; and a control portion configured to control the raising/lowering portion so as to lower the discharge stacking portion in response to a signal from the detecting portion when the stacking height of the upper surface of the sheets or the sheet bundle increases, and the control portion is configured to control, when the sheet bundle is discharged onto the discharge stacking portion, the moving portion so that a lowering amount of the pressing portion to press the sheet bundle is larger than a lowering amount of the pressing portion in a case where the sheets are discharged onto the discharge stacking portion.

19. An image forming apparatus according to claim 18, wherein the control portion controls the moving portion so as to move the lowered pressing portion to a retreat position, where the discharge of a subsequent sheet or a subsequent sheet bundle is prevented from being hindered, prior to discharge of the subsequent sheet or the subsequent sheet bundle onto the discharge stacking portion.

20. An image forming apparatus according to claim 18, wherein the pressing portion comprises:

a support member provided to a shaft extending along a width direction orthogonal to a discharge direction; and a pressing member supported by the support member in a pivotable manner, and pivoted cooperatively with the support member through intermediation of a spring member which is interposed between the pressing member and the support member when the support member is rotated cooperatively with the shaft, and wherein the support member pivots cooperatively with the pressing member until the pressing member abuts against the upper surface of the sheets or the sheet bundle, and the support member further pivots the pressing member against the spring member after the pressing member abuts against the upper surface of the sheets or the sheet bundle so as to increase a pressing force for pressing the sheets or the sheet bundle.

* * * * *